US011192391B2

(12) United States Patent
Taketsugu et al.

(10) Patent No.: US 11,192,391 B2
(45) Date of Patent: Dec. 7, 2021

(54) MEDIUM SUPPORTING STRUCTURE AND RECORDING DEVICE

(71) Applicant: SEIKO EPSON CORPORATION, Tokyo (JP)

(72) Inventors: Eiji Taketsugu, Matsumoto (JP); Tsuyoshi Himeno, Matsumoto (JP); Atsuhiko Takeuchi, Matsumoto (JP); Kenjiro Ishihara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/831,259

(22) Filed: Mar. 26, 2020

(65) Prior Publication Data

US 2020/0307263 A1 Oct. 1, 2020

(30) Foreign Application Priority Data

Mar. 29, 2019 (JP) ..... JP2019-066609

(51) Int. Cl.
*B41J 11/06* (2006.01)
*B65H 1/02* (2006.01)

(52) U.S. Cl.
CPC ..... *B41J 11/06* (2013.01); *B65H 1/02* (2013.01)

(58) Field of Classification Search
CPC ..... B41J 11/06; B41J 2/01; B65H 2402/32; B65H 2402/343; B65H 1/04; B65H 2405/11164; B65H 2405/212; B65H 1/02; B65H 31/02; B65H 2701/1131
See application file for complete search history.

(56) References Cited

U.S. PATENT DOCUMENTS 6,053,493 A * 4/2000 Yokoyama ..... B65H 1/266 211/126.7
6,287,032 B1 * 9/2001 Osmus ..... B41J 11/006 400/624
7,497,565 B2 * 3/2009 Kinoshita ..... B41J 13/103 271/10.1
8,272,637 B2 * 9/2012 Asada ..... B65H 31/02 271/171

(Continued)

FOREIGN PATENT DOCUMENTS

JP 2008-023838 2/2008
JP 2008-100806 5/2008

OTHER PUBLICATIONS

Machine translation of JP 2008-023838, published on Feb. 2008 (Year: 2008).*

(Continued)

*Primary Examiner* — Huan H Tran
(74) *Attorney, Agent, or Firm* — Workman Nydegger

(57) ABSTRACT

A feeding tray includes a first member supported, via a housing member, by a main body of a recording device configured to perform recording onto a medium, and a second member that includes a second support surface configured to support the medium and is coupled to the first member to be movable relatively to the first member, with a transport direction of the medium being a movement direction. The second member includes a second frame body forming an outer peripheral portion of the second member, and a plurality of second ribs spanning across the second frame body to form the second support surface.

16 Claims, 19 Drawing Sheets

(56) References Cited

U.S. PATENT DOCUMENTS

| | | | | |
|---|---|---|---|---|
| 8,602,412 | B2 * | 12/2013 | Ma | G03G 15/6552 271/207 |
| 9,162,842 | B2 * | 10/2015 | Komuro | B65H 31/20 |
| 9,376,284 | B2 * | 6/2016 | Komuro | B65H 31/02 |
| 10,377,601 | B2 * | 8/2019 | Tanaka | B65H 31/02 |
| 2006/0071399 | A1 * | 4/2006 | Asada | B65H 3/56 271/117 |
| 2008/0237977 | A1 * | 10/2008 | Izuchi | B65H 1/04 271/264 |
| 2009/0285279 | A1 * | 11/2009 | Nathawad | H03L 7/1976 375/238 |

OTHER PUBLICATIONS

Machine translation of JP 2008-100806, published on May 2008 (Year: 2008).*

* cited by examiner

MEDIUM SUPPORTING STRUCTURE AND RECORDING DEVICE

The present application is based on, and claims priority from JP Application Serial Number 2019-066609, filed Mar. 29, 2019, the disclosure of which is hereby incorporated by reference herein in its entirety.

BACKGROUND

1. Technical Field

The present disclosure relates to a medium supporting structure that supports a medium and a recording device including the medium supporting structure.

2. Related Art

Recording devices that record an image and the like on a surface of a medium such as a sheet by discharging ink onto the surface of the medium are known in the related art. For example, JP-A-2008-100806 discloses a recording device that performs recording by discharging ink onto a medium transported from a feeding tray provided on a rear-side upper portion of the recording device to a discharge tray provided on a front-side lower portion of the recording device.

Further, JP-A-2008-100806 discloses, as a medium supporting structure in the feeding tray, a telescopic medium supporting structure configured to allow members in a plurality of stages, which include a support surface that can support a medium, to be housed and pulled out. Such a medium supporting structure is configured to be able to support media of various sizes by a member in each stage being pulled out. Note that such a medium supporting structure is also applicable to the discharge tray.

In the medium supporting structure as in JP-A-2008-100806, a reduction in thickness that reduces a thickness direction being a direction orthogonal to the support surface is required with a reduction in size of the recording device as one of objectives, for example. The reduction in thickness of the medium supporting structure is achieved by a reduction in thickness of a member that can support a medium. However, in order to achieve the reduction in thickness of the member that can support the medium, there is a risk that mechanical strength of the member and thus mechanical strength of the whole medium supporting structure may excessively decrease.

SUMMARY

A medium supporting structure for solving the above-described problem includes a first member supported by a main body of a recording device configured to perform recording onto a medium, and a second member that includes a support surface configured to support the medium and is coupled to the first member to be movable relatively to the first member, with a transport direction of the medium on the support surface being a movement direction of the second member, wherein the second member is configured to be housed in the first member, and the second member also includes a frame body forming an outer peripheral portion of the second member, and a plurality of ribs spanning across the frame body to form the support surface.

A recording device for solving the above-described problem includes a feeding tray, a discharge tray, and a main body of a recording device, to which the feeding tray and the discharge tray are coupled, the recording device being configured to perform recording onto a medium in a process of transporting the medium from the feeding tray to the discharge tray, wherein a medium supporting structure in at least one of the feeding tray and the discharge tray includes a first member supported by the main body of the recording device configured to perform recording onto the medium, and a second member that includes a support surface configured to support the medium and is coupled to the first member to be movable relatively to the first member in a transport direction of the medium on the support surface as a movement direction, the second member is configured to be housed in the first member, and the second member also includes a frame body forming an outer peripheral portion of the second member, and a plurality of ribs spanning across the frame body and form the support surface.

DESCRIPTION OF EXEMPLARY EMBODIMENTS

One exemplary embodiment of a medium supporting structure and a recording device will be described below with reference to the accompanying drawings.

Figure 1:
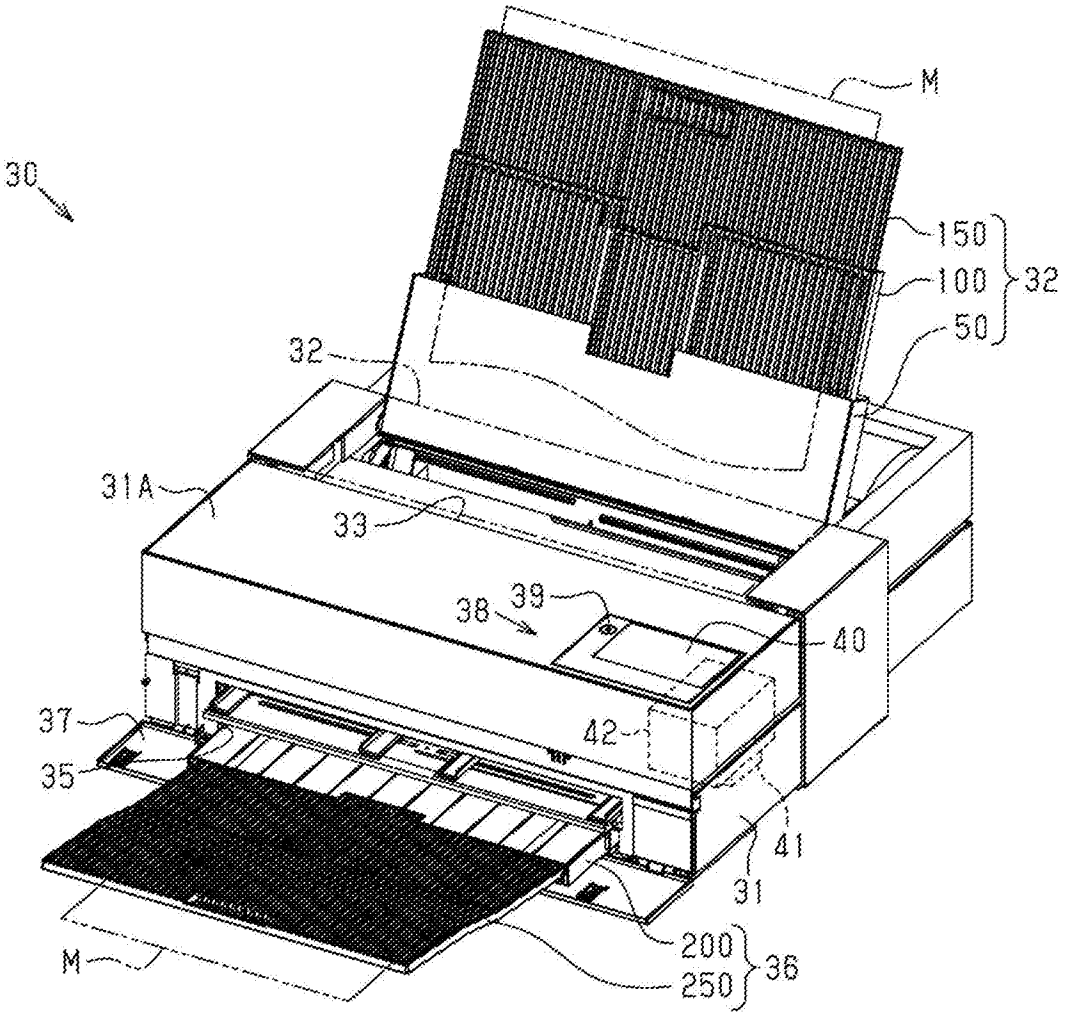
FIG. 1 is a perspective view illustrating a schematic configuration of one exemplary embodiment of a recording device.

A recording device 30 illustrated in FIG. 1 is an inkjet printer in a serial printing method. As illustrated in FIG. 1, the recording device 30 includes a main body 31 of the recording device 30 in a rectangular parallelepiped form. A feeding tray 32 on which a medium M such as a sheet before recording can be set by a user is provided on an upper surface of the main body 31 of the recording device 30. The medium M set on the feeding tray 32 is fed into the main body 31 of the recording device 30 through a feeding port 33.

Further, a discharge port 35 that discharges the medium M recorded by the recording device 30 and a discharge tray 36 in which the recorded medium M discharged from the discharge port 35 is loaded are provided on a front portion of the main body 31 of the recording device 30. Note that a retractable cover 37 is provided on a front lower portion of the main body 31 of the recording device 30, and the discharge tray 36 housed inside the main body 31 of the recording device 30 is covered with the closed cover 37.

Further, as illustrated in FIG. 1, an operating panel 38 is provided on an upper surface 31A of the main body 31 of the recording device 30. The operating panel 38 includes an operating unit 39, such as a power button, and a display unit 40 formed of a liquid crystal display and the like. A menu, various types of messages, and the like are displayed on the display unit 40. The recording device 30 is communicably coupled to a host device (not illustrated). When receiving recorded data from the host device, the recording device 30 feeds the medium M set on the feeding tray 32 by a feeding mechanism (not illustrated), and performs a recording operation of recording an image based on the recorded data on the fed medium M.

A carriage 42 including a recording head 41 that discharges a liquid such as ink onto the medium M is provided in the main body 31 of the recording device 30 so as to be movable reciprocally along a scanning direction orthogonal to a transport direction of the medium M. The recording operation of discharging a liquid droplet from the recording head 41 and performing recording of one pass in a process of the carriage 42 moving along the scanning direction, and a transport operation of transporting the medium M to a next recording position are alternately performed, and thus an image or a document is recorded on the medium M.

An attachment portion (none is illustrated) to which a liquid housing body such as an ink cartridge that houses a liquid such as ink used for recording is detachably attached is provided on one or both of portions on both sides that sandwich the discharge tray 36 on the front portion of the main body 31 of the recording device 30. Note that, in the present example, the liquid housing body is an off-carriage type that the liquid housing body is disposed in a position different from the carriage 42, but the liquid housing body may be an on-carriage type that the liquid housing body is detachably mounted on the carriage 42. Further, the recording device 30 is not limited to a serial recording method, and may be a line recording method in which the recording head 41 is an elongated line head disposed across the entire region at a maximum width of the medium M and liquid droplets can be discharged simultaneously onto the entire region at the width of the medium M.

The feeding tray 32 has a medium supporting structure of a three-stage structure constituted of a housing member 50, a first member 100, and a second member 150. The feeding tray 32 has a housing state in which the first member 100 and the second member 150 are housed in the housing member 50, and a developed state in which the first member 100 and the second member 150 are pulled out of the housing member 50 by a user operation and the medium M can be supported by the housing member 50, the first member 100, and the second member 150.

The feeding tray 32 is rotatably coupled to the main body 31 of the recording device 30 between an open position and a closed position. The feeding tray 32 holds the feeding port 33 in a closed state by being disposed in the closed position in the housing state, and is substantially flush with the upper surface 31A of the main body 31 of the recording device 30. In FIG. 1, the feeding tray 32 located in the closed position is indicated by a chain double-dashed line. The feeding tray 32 holds the feeding port 33 in an open state by being disposed in the open position. The open position is one of positions in which an operation from the housing state to the developed state and an operation from the developed state to the housing state are possible.

The discharge tray 36 is a portion on which the medium M after the main body 31 of the recording device 30 performs recording is disposed. The discharge tray 36 has a medium supporting structure of a two-stage structure constituted of a discharge-side first member 200 and a discharge-side second member 250.

The discharge tray 36 has a housing state in which the discharge-side second member 250 is housed in the discharge-side first member 200, and a developed state in which the discharge-side second member 250 is pulled out of the discharge-side first member 200 and the medium M can be supported by the discharge-side first member 200 and the discharge-side second member 250. The discharge tray 36 is housed in the housing state in the main body 31 of the recording device 30. The discharge-side first member 200 is coupled to the main body 31 of the recording device 30 such that the discharge-side first member 200 can be pulled out toward the front side. The discharge tray 36 shifts to the developed state by pulling the discharge-side first member 200 and the discharge-side second member 250 out of the main body 31 of the recording device 30 when the discharge port 35 formed in the main body 31 of the recording device 30 is in the open state.

Overall Configuration of Feeding Tray 32

The feeding tray 32 will be described in more detail with reference to FIGS. 2 to 17.

Figure 2:
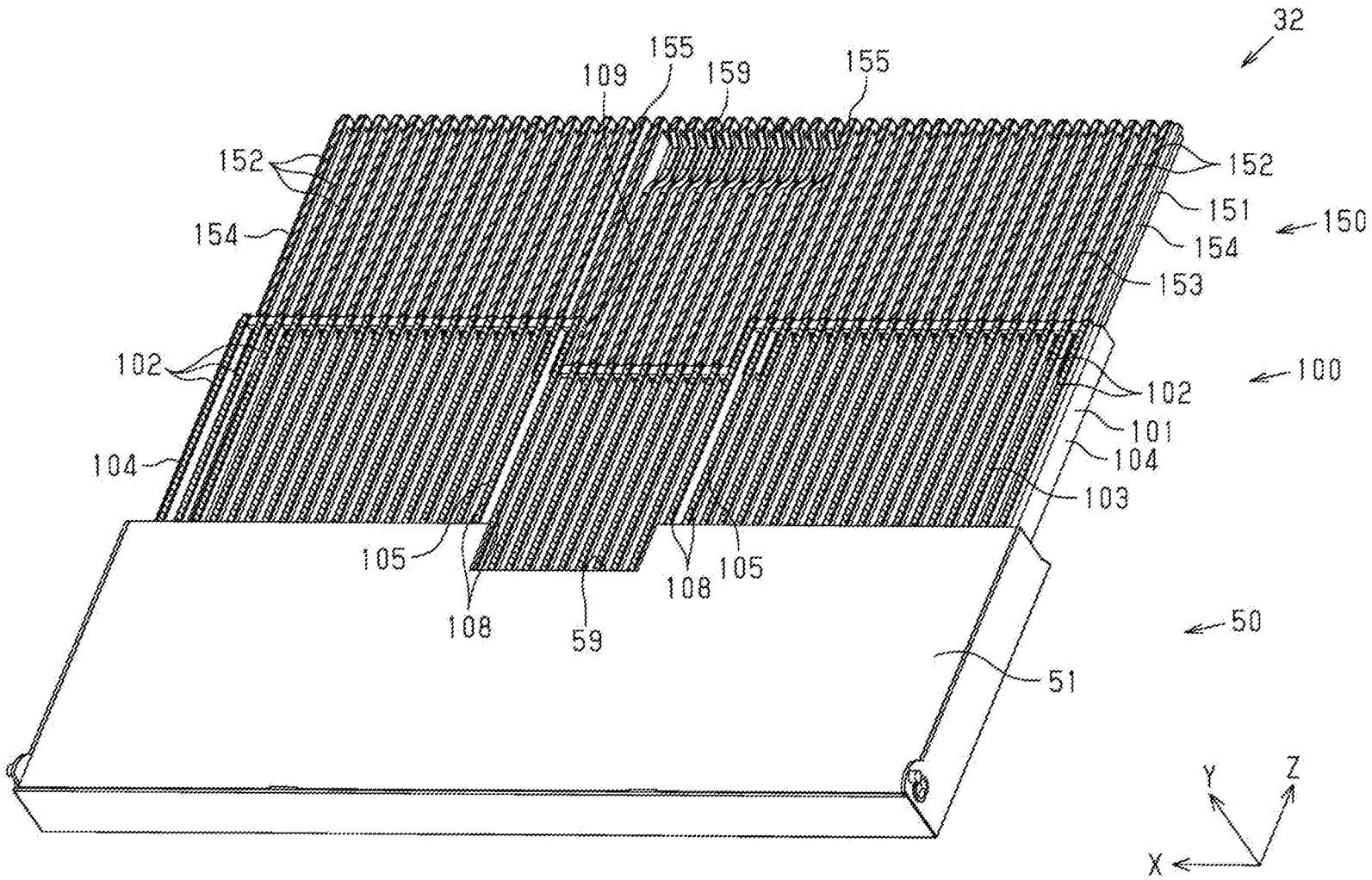
FIG. 2 is a front perspective view illustrating a developed state of a feeding tray including one exemplary embodiment of a medium supporting structure.

A schematic configuration of the feeding tray 32 will be described with reference to FIGS. 2 and 3. An X axis, a Y axis, and a Z axis described in FIG. 2 are three axes that are set for the feeding tray 32 and are orthogonal to one another. Directions indicated by arrows indicating the X axis, the Y axis, and the Z axis indicate positive directions along the X axis, the Y axis, and the Z axis, respectively. The positive directions along the X axis, the Y axis, and the Z axis are indicated by an +X direction, a +Y direction, and a +Z direction, respectively. Directions opposite to the directions indicated by the arrows indicating the X axis, the Y axis, and the Z axis are negative directions along the X axis, the Y axis, and the Z axis, respectively. The negative directions along the X axis, the Y axis, and the Z axis are indicated by an −X direction, a −Y direction, and a −Z direction, respectively. The directions along the X axis, the Y axis, and the Z axis regardless of positive or negative are referred to as an X direction, a Y direction, and a Z direction, respectively.

The X direction is a direction corresponding to a width direction of the feeding tray 32, and is a direction parallel to the scanning direction of the recording head 41. The +X direction is a direction facing one end of the feeding tray 32, and the −X direction is a direction facing the other end of the feeding tray 32. The Y direction is a direction corresponding to a thickness direction of the feeding tray 32. The +Y direction is a direction facing the front of the feeding tray 32, and the −Y direction is a direction facing the rear of the feeding tray 32. The Z direction is a direction corresponding to a movement direction of the first member 100 and the second member 150. The +Z direction corresponds to a pulling direction being is a movement direction when the first member 100 and the second member 150 are pulled out of the housing member 50. The −Z direction corresponds to the transport direction of the medium M on the feeding tray 32, and also corresponds to a housing direction being a movement direction when the first member 100 and the second member 150 are housed in the housing member 50. The XYZ axes illustrated in FIGS. 3 to 17 correspond to the XYZ axes in FIG. 2.

Figure 3:
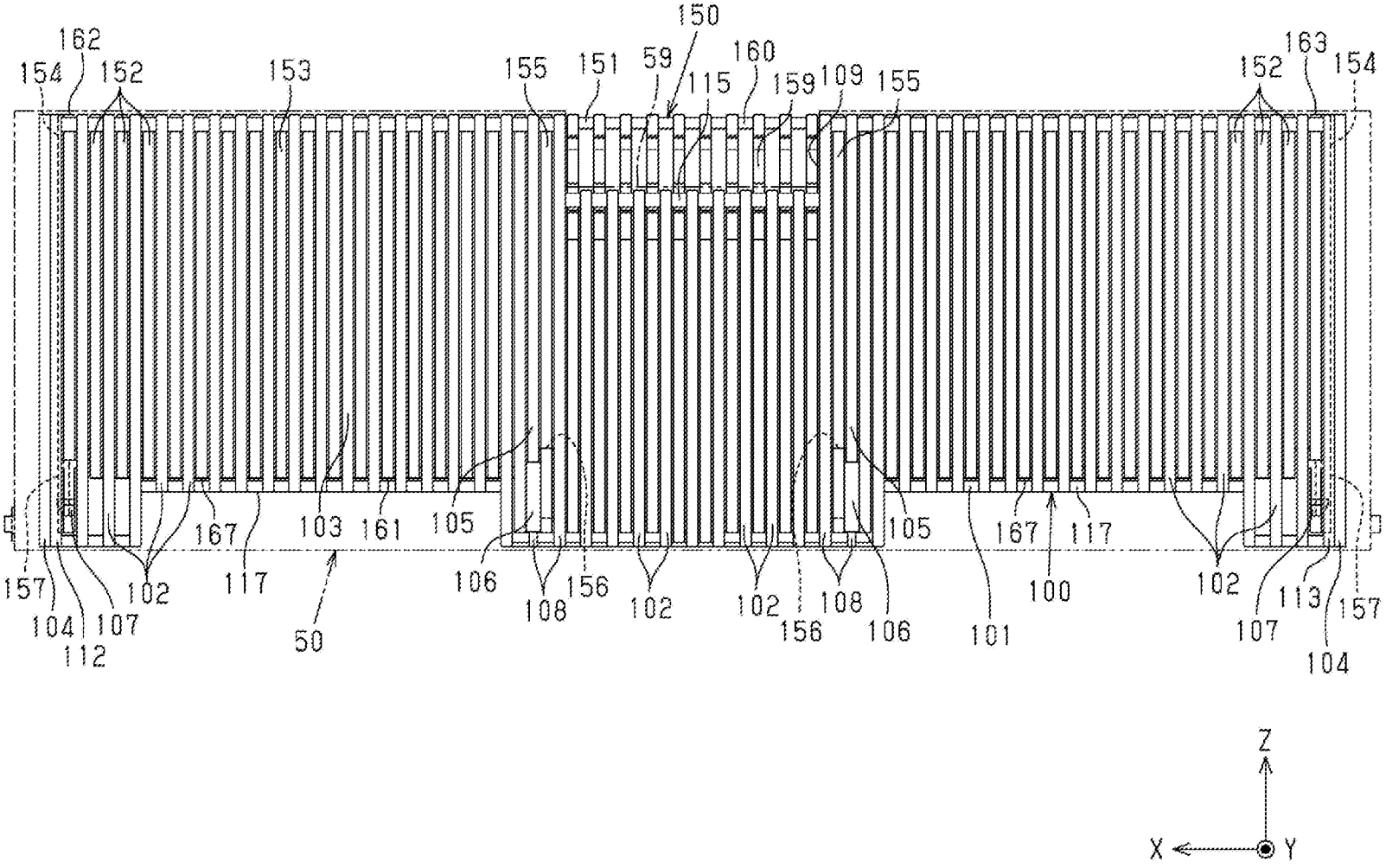
FIG. 3 is a front view illustrating a housing state of the feeding tray with some members being omitted.

As illustrated in FIGS. 2 and 3, the housing member 50 functions as a third member coupled to the main body 31 of the recording device 30. The housing member 50 is rotatably coupled to the main body 31 of the recording device 30 with an axis along the X direction as a rotation axis. The housing member 50 is formed in a flat and substantially rectangular parallelepiped box shape in which a dimension value decreases in order of the X direction, the Z direction, and the Y direction. The housing member 50 is a member that can house the first member 100 and the second member 150. The housing member 50 includes, in the +Y direction, a planar device-side support surface 51 that is a surface including the X direction and the Z direction and can support the medium M.

As illustrated in FIGS. 2 and 3, the first member 100 is coupled to the housing member 50 so as to be movable along the Z direction. The first member 100 is supported by the main body 31 of the recording device 30 via the housing member 50.

The first member 100 includes a first frame body 101 and a plurality of first ribs 102. The first frame body 101 forms an outer peripheral portion of the first member 100. The first rib 102 is integrally coupled to the first frame body 101. The plurality of first ribs 102 span the first frame body 101 in the Z direction, and are arranged in the X direction at predetermined intervals. The first rib 102 includes a portion protruding in the +Y direction farther than the first frame body 101. In the first member 100, a planar first support surface 103 that is a surface including the X direction and the Z direction and can support the medium M is formed by the portion of the plurality of first ribs 102 that protrudes in the +Y direction farther than the first frame body 101. The first support surface 103 supports the medium M while at least the first member 100 is pulled out of the housing member 50. Note that the first support surface 103 may be a surface that can support the medium M, and may include a portion inclined toward the X direction and the Z direction or a curved portion. Further, in FIG. 2, a hatching pattern is provided to the portion of each of the first ribs 102 constituting the first support surface 103.

The first frame body 101 includes a pair of first protruding portions 104. One of the pair of first protruding portions 104 is located at an end portion of the first frame body 101 in the +X direction, and protrudes in the +X direction toward the outside of the first frame body 101. The other of the pair of first protruding portions 104 is located at an end portion of the first frame body 101 in the −X direction, and protrudes in the −X direction toward the outside of the first frame body 101. Each of the pair of first protruding portions 104 engages with the housing member 50. The pair of first protruding portions 104 engage with the housing member 50, thereby restricting displacement in the Y direction of the first member 100.

The plurality of first ribs 102 include a pair of first engagement ribs 105. One of the pair of first engagement ribs 105 is located in the +X direction in the first member 100, and the other of the pair of first engagement ribs 105 is located in the −X direction in the first member 100. Each of the pair of first engagement ribs 105 is the first rib 102 engaging with the housing member 50. The pair of first engagement ribs 105 engage with the housing member 50, thereby guiding a movement in the Z direction of the first member 100 and also restricting displacement in the X direction of the first member 100.

A first low friction member 106 is attached to each of the pair of first engagement ribs 105. The first low friction member 106 corresponds to a low friction member interposed between the housing member 50 and the first member 100. The first low friction member 106 is configured to be able to contact the housing member 50 in the X direction when the first member 100 moves in the Z direction.

The first member 100 is configured to be movable along the Z direction between a first housing position and a first developed position that are relative positions with respect to the housing member 50.

The first housing position is a position in which the first member 100 is housed in the housing member 50, and the first support surface 103 is disposed in the −Y direction relative to the device-side support surface 51 of the housing member 50. The first housing position is a position in which the first support surface 103 overlaps the housing member 50 when viewed from the Y direction.

The first developed position is a position in which the first support surface 103 is disposed in the +Z direction relative to the housing member 50. The first developed position is a position in which the first support surface 103 can support the medium M in a position adjacent to the housing member 50 in the +Z direction. In other words, the first developed position is a position in which the first member 100 is pulled out of the housing member 50 in the +Z direction, and the first support surface 103 can support the medium M.

The first member 100 includes a pair of first engagement portions 107 that lock the first member 100 in the first developed position. One of the pair of first engagement portions 107 is located at an end portion in the −Z direction of an end portion of the first member 100 in the +X direction. The other of the pair of first engagement portions 107 is located at an end portion in the −Z direction of an end portion of the first member 100 in the −X direction. The first member 100 is locked in the first developed position by each of the pair of first engagement portions 107 snap-engaging with the housing member 50 in the process of the first member 100 moving toward the first developed position.

The plurality of first ribs 102 include a pair of second rib guide portions 108. Each of the pair of second rib guide portions 108 is constituted of the two first ribs 102 adjacent to each other in the X direction. One of the pair of second rib guide portions 108 is located in the +X direction in the first member 100, and the other of the pair of second rib guide portions 108 is located in the −X direction in the first member 100. The second rib guide portion 108 guides a movement of the second member 150 in the Z direction, and also restricts displacement of the second member 150 in the X direction. Note that, in the present exemplary embodiment, the first engagement rib 105 is set to one of the first ribs 102 that constitute the second rib guide portion 108. The second rib guide portion 108 corresponds to a "rib guide portion" of the present application.

As illustrated in FIGS. 2 and 3, the second member 150 is coupled to the first member 100 so as to be movable along the Z direction, and is supported by the main body 31 of the recording device 30 via the first member 100 and the housing member 50.

The second member 150 includes a second frame body 151 and a plurality of second ribs 152. The second frame body 151 forms an outer peripheral portion of the second member 150. The second rib 152 is integrally coupled to the second frame body 151. The second ribs 152 span the second frame body 151 in the Z direction, and are arranged in the X direction at predetermined intervals. The second rib 152 is located between the first ribs 102 adjacent to each other in the X direction in plan view from the +Y direction to the −Y direction. The second rib 152 includes a portion protruding in the +Y direction farther than the second frame body 151. In the second member 150, a planar second support surface 153 that is a surface including the X direction and the Z direction and can support the medium M is formed by the portion of the plurality of second ribs 152 that protrudes in the +Y direction farther than the second frame body 151. The second support surface 153 supports the medium M while at least the second member 150 is pulled out of the first member 100. Note that the second support surface 153 may be a surface that can support the medium M, and may include a portion inclined toward the X direction and the Z direction or a curved portion. Further, in FIG. 2, a hatching pattern is provided to the portion of each of the second ribs 152 constituting the second support surface 153. Further, the second support surface 153 is located in the −Y direction relative to the first support surface 103. In the X direction, a slit is formed between the plurality of second ribs 152. The slit is a rectangular through hole extending in the Z direction being the transport direction of the medium M on the second support surface 153.

The second frame body 151 includes a pair of second protruding portions 154. One of the pair of second protruding portions 154 protrudes in the +X direction toward the outside of the second frame body 151 in the X direction. The other of the pair of second protruding portions 154 protrudes in the −X direction toward the outside of the second frame body 151 in the X direction. Each of the pair of second protruding portions 154 engages with the first member 100. Each of the pair of second protruding portions 154 engages with the first member 100, thereby restricting displacement in the Y direction of the second member 150. Note that the pair of second protruding portions 154 correspond to "protruding portions" of the present application.

The plurality of second ribs 152 include a pair of second engagement ribs 155. One of the pair of second engagement ribs 155 is located in the +X direction in the second member 150, and the other of the pair of second engagement ribs 155 is located in the −X direction in the second member 150. The second engagement rib 155 is the second rib 152 that engages with the second rib guide portion 108 of the first member 100. The second engagement rib 155 engages with the second rib guide portion 108 of the first member 100, thereby guiding a movement in the Z direction of the second member 150 and also restricting displacement in the X direction of the second member 150.

A second low friction member 156 is attached to each of the pair of second engagement ribs 155. The second low friction member 156 corresponds to a low friction member interposed between the first member 100 and the second member 150. The second low friction member 156 is configured to be able to contact the second rib guide portion 108 of the first member 100 in the X direction when the second member 150 moves in the Z direction.

The second member 150 is configured to be movable along the Z direction between a second housing position and a second developed position that are relative positions with respect to the first member 100.

The second housing position is a position in which the second support surface 153 is disposed in the −Y direction relative to the first support surface 103 of the first member 100. The second housing position is a position in which the second support surface 153 overlaps the first member 100 when viewed from the Y direction. As described above, since the second support surface 153 is located in the −Y direction relative to the first support surface 103, the second support surface 153 does not support the medium M in the second housing position. Note that the second member 150 is housed in the housing member 50 when the first member 100 is located in the first housing position and the second member 150 is located in the second housing position.

The second developed position is a position in which the second support surface 153 is disposed in the +Z direction relative to the first member 100. The second developed position is a position in which the second support surface 153 can support the medium M in a position adjacent to the first member 100 in the +Z direction. In other words, the second developed position is a position in which the second member 150 is pulled out of the first member 100 in the +Z direction, and the second support surface 153 can support the medium M.

In other words, the second member 150 includes the second support surface 153 that can support the medium M, and is coupled to the first member 100 so as to be movable relatively to the first member 100 in the transport direction (Z direction) of the medium M on the second support surface 153.

The second member 150 includes a pair of second engagement portions 157. One of the pair of second engagement portions 157 is located at an end portion in the −Z direction of an end portion of the second member 150 in the +X direction. The other of the pair of second engagement portions 157 is located at an end portion in the −Z direction of an end portion of the second member 150 in the −X direction. The second member 150 is locked in the second developed position by each of the pair of second engagement portions 157 snap-engaging with the first member 100 in the process of the second member 150 moving toward the second developed position.

The second member 150 includes an operating portion 159 at an end portion in the +Z direction of a central portion in the X direction. The operating portion 159 is constituted of a recessed portion being recessed in the −Y direction and formed in a part of the second rib 152 located in the central portion in the X direction among the plurality of second ribs 152. Further, the first member 100 includes a first operating port 109 that exposes the operating portion 159 of the second member 150 in the +Y direction in the feeding tray 32 in the housing state. Further, the housing member 50 includes an operating port 59 that exposes the operating portion 159 of the second member 150 in the +Y direction in the feeding tray 32 in the housing state. When the feeding tray 32 in the housing state is located in the open position, the operating unit 159 of the second member 150 is operated in the +Z direction, and thus the second member 150 and the first member 100 are sequentially pulled out of the housing member 50, and the feeding tray 32 shifts to the developed state.

Housing Member 50

The configuration of the housing member 50 will be described in more detail with reference to FIGS. 4 and 5.

Figure 4:
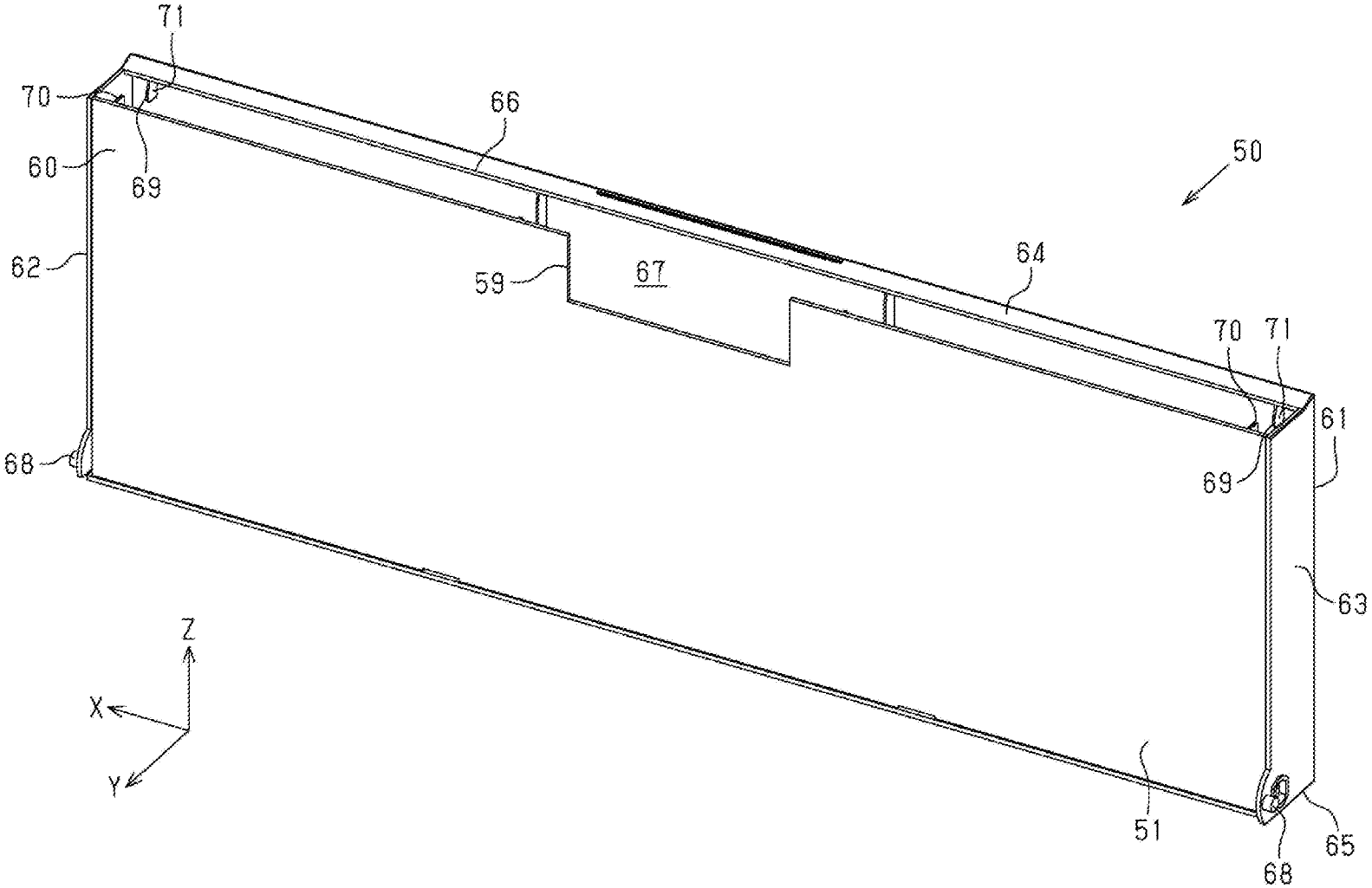
FIG. 4 is a front perspective view illustrating a housing member.

As illustrated in FIG. 4, the housing member 50 is formed in a box shape having an opening in the +Z direction. The housing member 50 includes a front wall 60, a rear wall 61, a side wall 62, a side wall 63, a top wall 64, and a bottom wall 65. The housing member 50 is manufactured by assembling a plurality of resin molded articles molded from, for example, ABS resin or the like to each other.

The front wall 60 and the rear wall 61 are walls including the X direction and the Z direction. The front wall 60 is located in the +Y direction, and the rear wall 61 is located in the −Y direction. The side wall 62 and the side wall 63 are walls including the Y direction and the Z direction. The side wall 62 is located in the +X direction, and the side wall 63 is located in the −X direction. The top wall 64 and the bottom wall 65 are walls including the X direction and the Y direction. The top wall 64 is located in the +Z direction, and the bottom wall 65 is located in the −Z direction.

The housing member 50 has a housing port 66 in the +Z direction. The housing port 66 is formed by closing, with the top wall 64, a region on the −Y direction side of the opening in the +Z direction formed by the front wall 60, the rear wall 61, the side wall 62, and the side wall 63. The housing port 66 is an opening surrounded by an end portion in the +Z direction of the front wall 60, end portions in the +Z direction of the side wall 62 and the side wall 63, and an end portion in the +Y direction of the top wall 64. The housing port 66 is formed in a shape that allows the first member 100 and the second member 150 to pass along the Z direction while the second member 150 remains in the second housing position. In other words, the feeding tray 32 is configured to allow the first member 100 and the second member 150 to be housed and pulled out of a housing portion 67, which is an internal space of the housing member 50, through the housing port 66.

The housing member 50 includes the device-side support surface 51 on the front wall 60. The device-side support surface 51 is a surface located in the +Y direction on the front wall 60, and is configured such that the device-side support surface 51 can support the medium M placed on the feeding tray 32.

The housing member 50 has the operating port 59 in the front wall 60. The operating port 59 is formed at an end portion of the front wall 60 in the +Z direction, which is a central portion of the front wall 60 in the X direction. The operating port 59 is a rectangular recessed portion acquired by cutting a part of the front wall 60 from the end portion in the +Z direction to the −Z direction when viewed from the +Y direction. In the feeding tray 32 in the housing state, the operating port 59 can expose, in the +Y direction, the operating portion 159 formed in the second member 150.

The housing member 50 includes a pair of hinge portions 68. One of the pair of hinge portions 68 protrudes in the +X direction from a corner portion formed by an end portion in the −Z direction and an end portion in the +Y direction of the side wall 62. The other of the pair of hinge portions 68 protrudes in the −X direction from a corner portion formed by an end portion in the −Z direction and an end portion in the +Y direction of the side wall 63. The housing member 50 is rotatably attached to the main body 31 of the recording device 30 with, as a rotation axis, an axis along the X direction by pivotally supporting the hinge portions 68 on a pivotally supporting portion (not illustrated) formed on the main body 31 of the recording device 30.

The housing member 50 includes a pair of first frame body guide portions 69. One of the pair of first frame body guide portions 69 is located in the +X direction in the housing member 50, and the other of the pair of first frame body guide portions 69 is located in the −X direction in the housing member 50. Each of the pair of first frame body guide portions 69 is constituted of a front protruding portion 70 and a rear protruding portion 71. The front protruding portion 70 protrudes in the −Y direction from the front wall 60 and extends in the Z direction from the end portion in the −Z direction to the end portion in the +Z direction of the front wall 60. The rear protruding portion 71 protrudes in the +Y direction from the rear wall 61. The rear protruding portion 71 is integrally coupled to an end portion in the +Z direction of the rear wall 61 and an end portion in the X direction of the top wall 64. The rear protruding portion 71 protrudes slightly in the +Y direction relative to the top wall 64. The first frame body guide portion 69 sandwiches the first protruding portion 104 in the Y direction with the front protruding portion 70 and the rear protruding portion 71, thereby forming a passage through which the first protruding portion 104 passes during a movement of the first member 100. The first frame body guide portion 69 engages with the first protruding portion 104, thereby restricting displacement in the Y direction of the first member 100.

Figure 5:
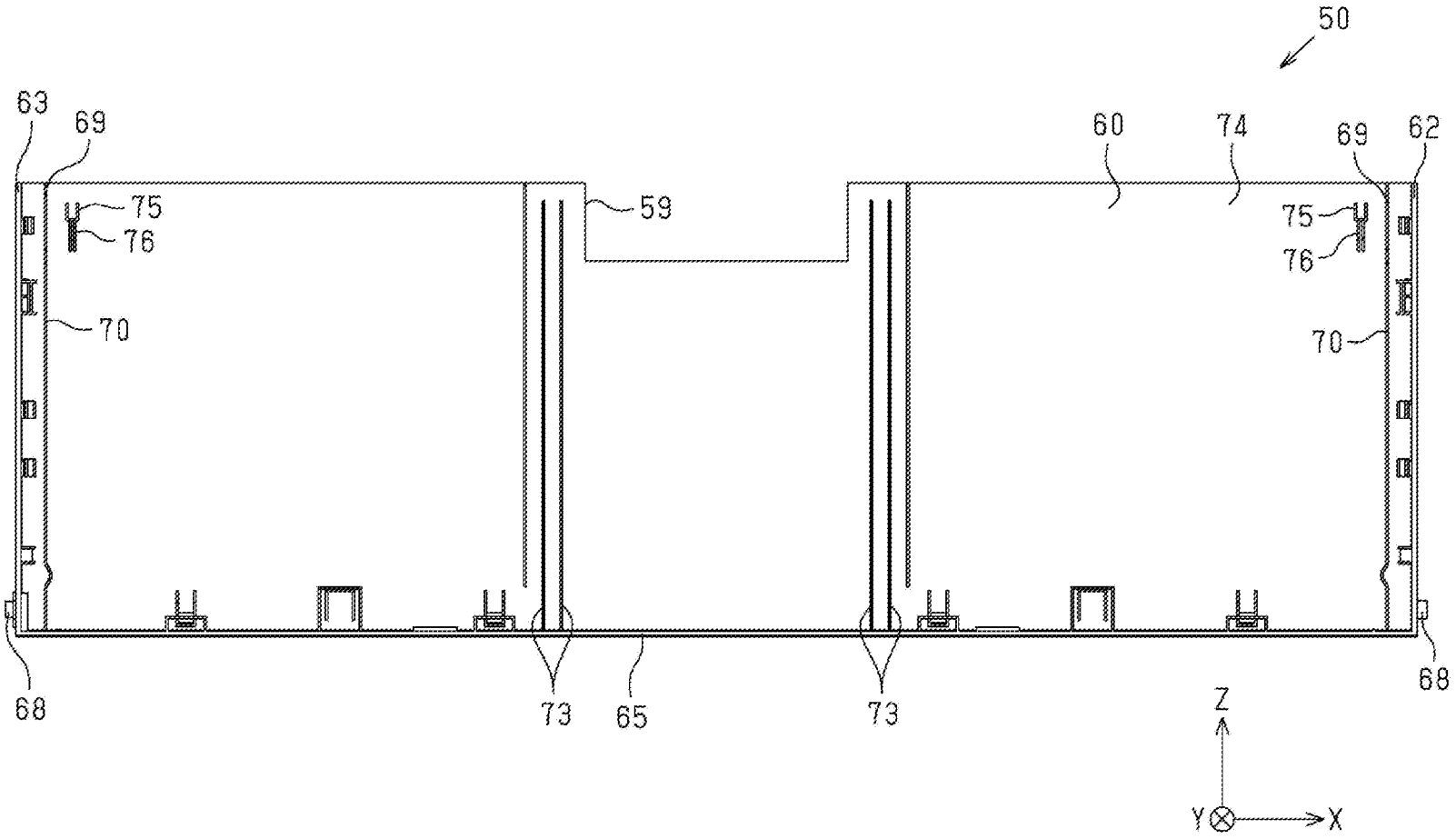
FIG. 5 is a front wall rear view illustrating a rear side of a front wall of the housing member.

As illustrated in FIG. 5, the housing member 50 includes a pair of first rib guide portions 73. The pair of first rib guide portions 73 are integrally formed on a front-side inner surface 74 located in the −Y direction on the front wall 60. One of the pair of first rib guide portions 73 is located in the +X direction on the front-side inner surface 74, and the other of the pair of first rib guide portions 73 is located in the −X direction on the front-side inner surface 74. The first rib guide portion 73 is constituted of a pair of projecting portions extending in the Z direction from the end portion in the −Z direction to the vicinity of the housing opening 66.

The housing member 50 includes a pair of first member locking portions 75. The pair of first member locking portions 75 are integrally formed on the front-side inner surface 74 of the front wall 60. One of the pair of first member locking portions 75 is located at a corner portion formed by an end portion in the +X direction and an end portion in the +Z direction of the front-side inner surface 74. The other of the pair of first member locking portions 75 is located at a corner portion formed by an end portion in the −X direction and an end portion in the +Z direction of the front-side inner surface 74.

Figure 7:
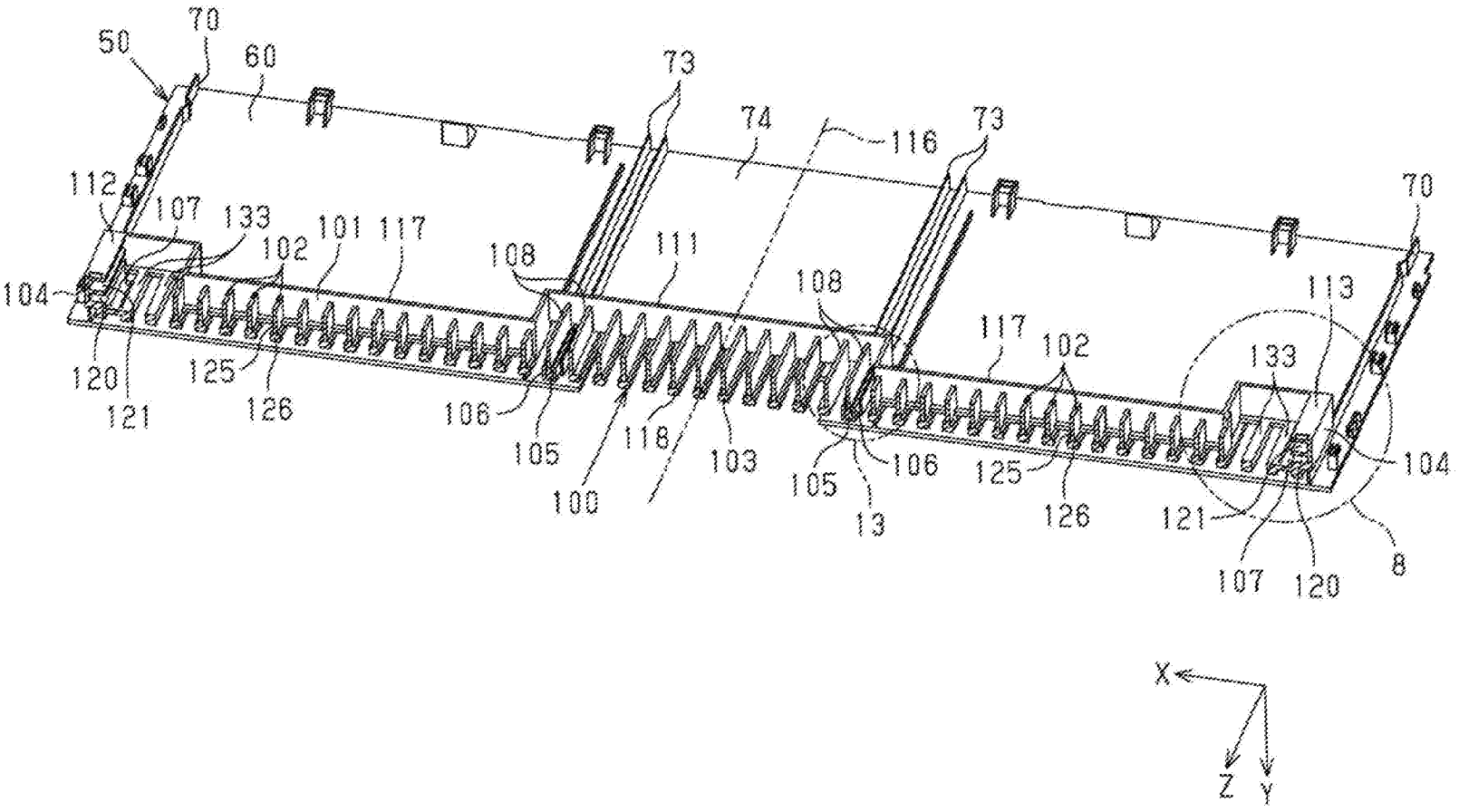
FIG. 7 is a cross-sectional perspective view illustrating a cross section of the first member taken along a 7-7 line in FIG. 6 together with the front wall of the housing member.

As illustrated in FIG. 7, the first rib guide portion 73 sandwiches the first engagement rib 105 of the first member 100 in the X direction via the first low friction member 106, thereby restricting displacement of the first member 100 in the X direction while guiding a movement of the first member 100 in the Z direction.

Figure 14:
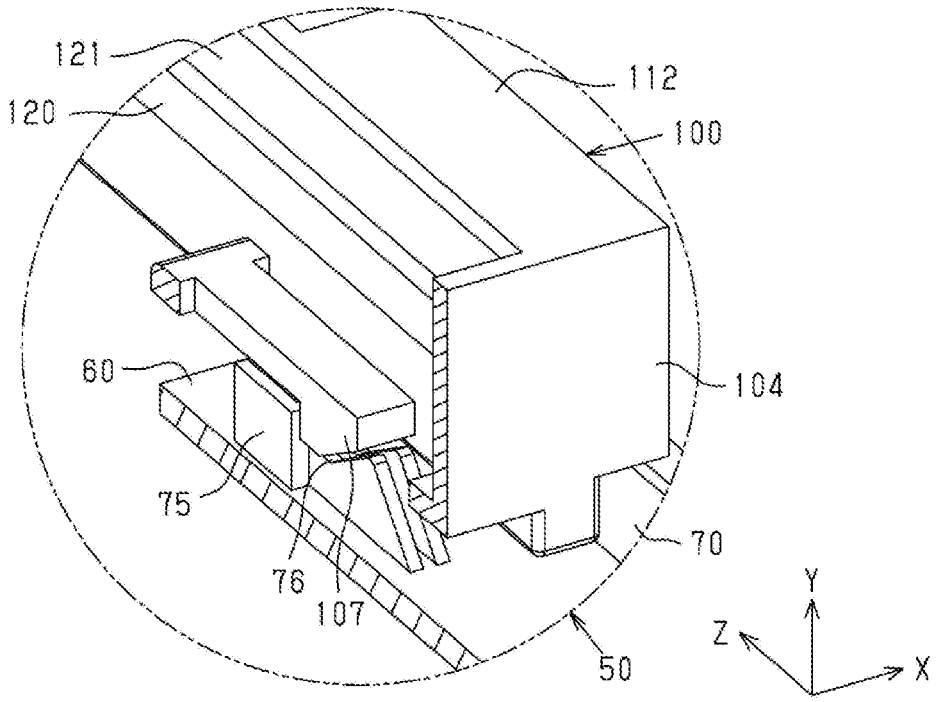
FIG. 14 is a rear perspective view illustrating a locking portion of the first member.

As illustrated in FIG. 14, the first member locking portion 75 includes a first member locking recessed portion 76 being recessed in the +Y direction. The first member locking portion 75 locks the first member 100 in the first developed position by the first engagement portion 107 of the first member 100 snap-engaging with the first member locking recessed portion 76 from the −Y direction due to a movement of the first member 100 in the +Z direction relative to the housing member 50.

First Member 100

The configuration of the first member 100 will be described in more detail with reference to FIGS. 6 to 14.

Figure 6:
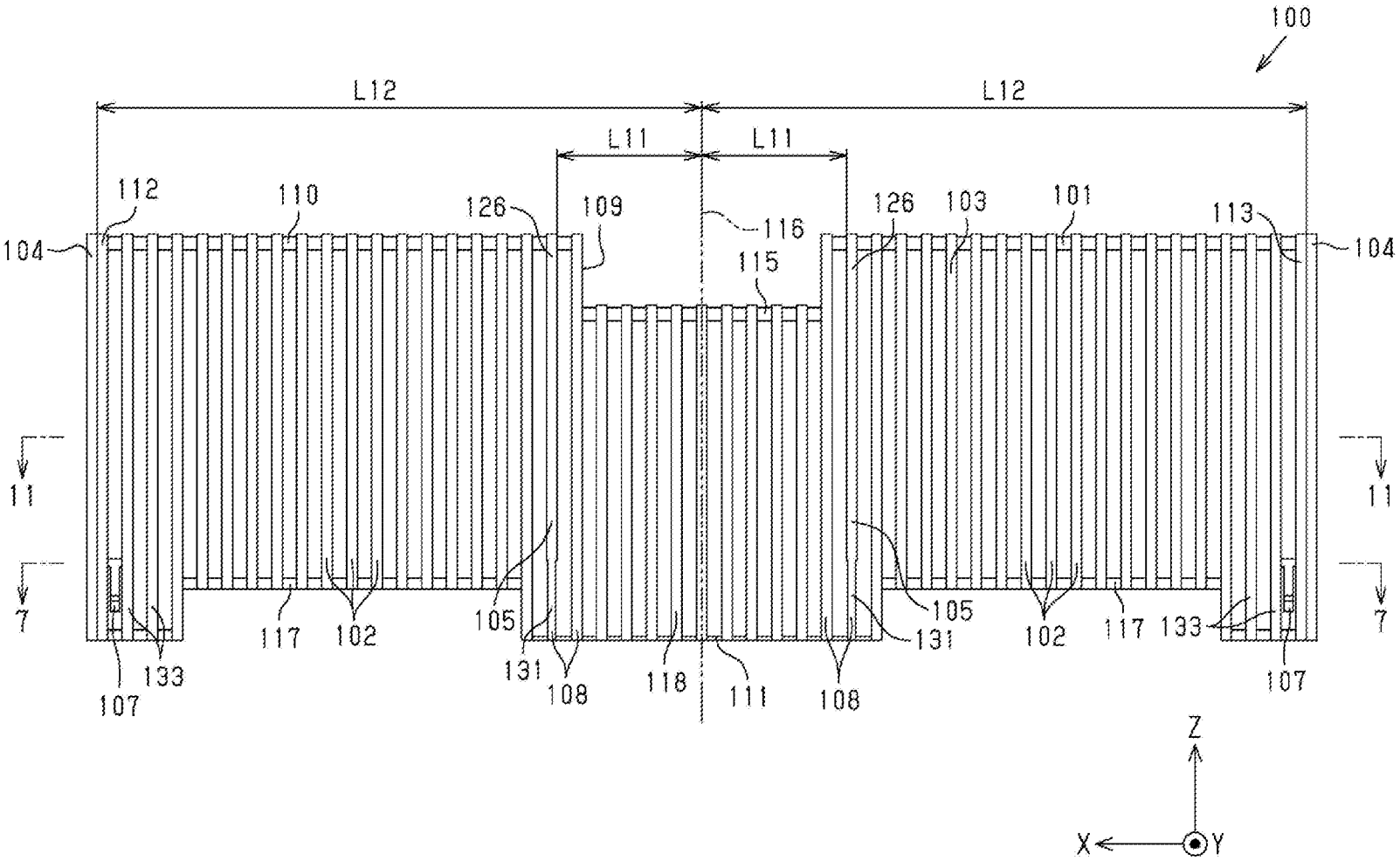
FIG. 6 is a front view illustrating a first member.

As illustrated in FIG. 6, the first member 100 is manufactured by various molding methods using a resin material such as ABS resin, for example. The first member 100 includes the first frame body 101 and the plurality of first ribs 102. The first frame body 101 forms the outer peripheral portion of the first member 100. The first rib 102 is integrally coupled to the first frame body 101.

The first frame body 101 includes a first upper frame 110, a first lower frame 111, a first side frame 112, and a first side frame 113. The first upper frame 110 is located in the +Z direction in the first frame body 101, and the first lower frame 111 is located in the −X direction in the first frame body 101. The first side frame 112 is located in the +X direction in the first frame body 101, and the first side frame 113 is located in the −X direction in the first frame body 101.

The first upper frame 110 extends in the X direction at the end portion in the +Z direction of the first frame body 101. The first upper frame 110 includes a first upper frame recessed portion 115 that forms the first operating port 109 in the central portion in the X direction. The first upper frame recessed portion 115 is a recessed portion in which the central portion of the first upper frame 110 in the X direction is recessed in the −Z direction. The first upper frame recessed portion 115 is formed in a bent shape including a plurality of bent portions. The first upper frame recessed portion 115 is formed in the X direction across a first central line 116 being a virtual line that indicates the center of the first member 100 in the X direction. When the first member 100 is located in the first housing position, the first upper frame recessed portion 115 is disposed in the −Y direction relative to the front wall 60 of the housing member 50. In other words, when the first member 100 is located in the first housing position, the first upper frame recessed portion 115 is covered with the front wall 60 of the housing member 50 in plan view in the −Y direction from the +Y direction.

In the first upper frame recessed portion 115 having such a bent shape, a load acting on the first frame body 101 is effectively dispersed. Thus, by providing the first frame body 101 with the first upper frame recessed portion 115, the mechanical strength of the first frame body 101 itself can be increased.

The first lower frame 111 extends in the X direction at the end portion in the −Z direction of the first frame body 101. The first lower frame 111 is disposed in the −Y direction relative to the front wall 60 of the housing member 50 regardless of a relative position of the first member 100 with respect to the housing member 50. In other words, the first lower frame 111 is always covered with the front wall 60 in plan view in the −Y direction from the +Y direction. The first lower frame 111 includes a pair of first lower frame recessed portions 117 being recessed toward the +Z direction. One of the pair of first lower frame recessed portions 117 is located in the +X direction relative to the first upper frame recessed portion 115 of the first upper frame 110. The other of the pair of first lower frame recessed portions 117 is located in the −X direction relative to the first upper frame recessed portion 115 of the first upper frame 110. The first lower frame recessed portion 117 is formed in a bent shape including a plurality of bent portions. In the pair of first lower frame recessed portions 117, a load acting on the first frame body 101 is effectively dispersed. Thus, by providing the first frame body 101 with the pair of first lower frame recessed portions 117, the mechanical strength of the first frame body 101 itself can be increased. Further, by maintaining a state in which the pair of first lower frame recessed portions 117 are covered with the front wall 60, the mechanical strength of the first frame body 101 itself can be increased while increasing design property of the feeding tray 32. Note that the plurality of first ribs 102 corresponding to the portions of the first member 100 sandwiched by the pair of first lower frame recessed portions 117 in the X direction are lower-stage operating port arrangement portions 118 disposed so as to cover the operating port 59 formed in the housing member 50 from the −Y direction when the first member 100 is located in the first developed position.

The first side frame 112 extends along the Z direction in the +X direction of the first frame body 101, and integrally couples an end portion of the first upper frame 110 to an end portion of the first lower frame 111 in the +X direction. The first side frame 113 extends along the Z direction in the −X direction of the first frame body 101, and integrally couples an end portion of the first upper frame 110 to an end portion of the first lower frame 111 in the −X direction.

As illustrated in FIGS. 6 and 7, the first frame body 101 includes the pair of first protruding portions 104. One of the pair of first protruding portions 104 is formed on the first side frame 112. One of the pair of first protruding portions 104 protrudes in the +X direction from the first side frame 112 toward the outside of the first frame body 101 in the X direction. The other of the pair of first protruding portions 104 is formed on the first side frame 113. The other of the pair of first protruding portions 104 protrudes in the −X direction from the first side frame 112 toward the outside of the first frame body 101 in the X direction. The pair of first protruding portions 104 form a protruding portion on the end surface of the first frame body 101 in the X direction, thereby constituting the end portion of the first member 100 in the X direction. When the first member 100 moves with respect to the housing member 50, the first protruding portion 104 moves in the Z direction while contacting the first frame body guide portion 69 formed in the housing member 50. Specifically, the first protruding portion 104 moves in a position sandwiched by the front protruding portion 70 and the rear protruding portion 71 of the housing member 50 in the Y direction, and in a position away from the side walls 62 and 63 of the housing member 50 in the X direction. The first protruding portion 104 contacts the front protruding portion 70 or the rear protruding portion 71, and thus displacement in the Y direction of the first member 100 with respect to the housing member 50 is restricted by the end portion in the X direction.

Figure 8:
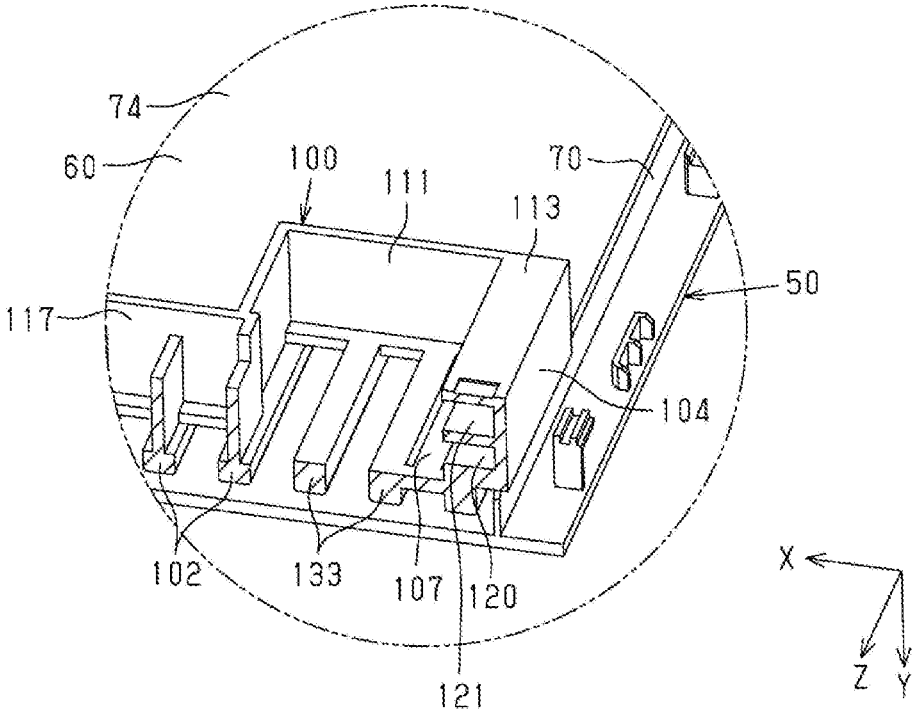
FIG. 8 is an enlarged view of a portion surrounded by a chain double-dashed line 8 in FIG. 7.
Figure 9:
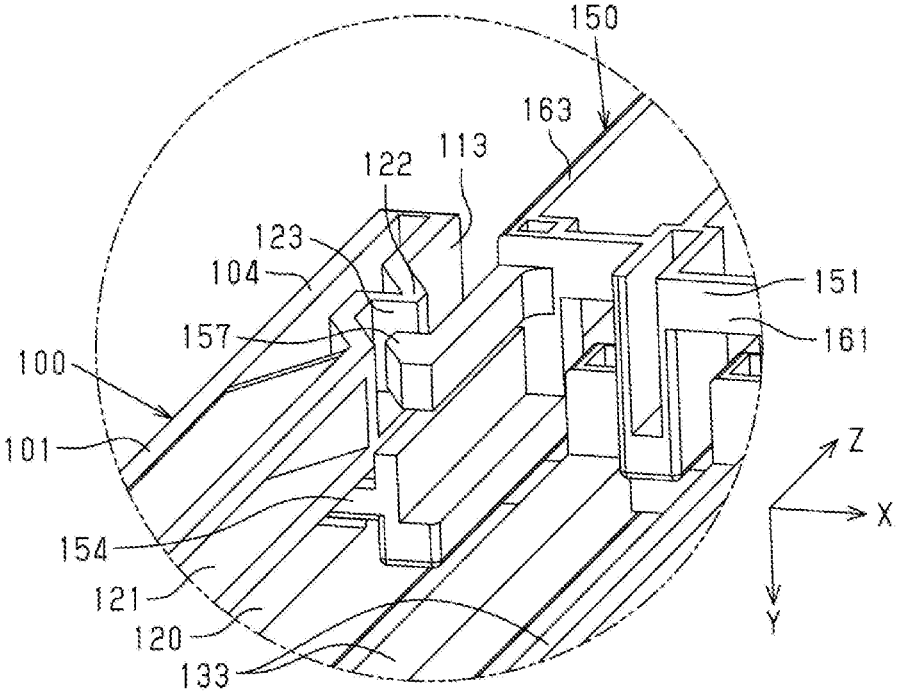
FIG. 9 is a rear perspective view illustrating a locking portion of a second member.

As illustrated in FIGS. 8 and 9, the first frame body 101 includes a pair of second frame body guide portions 120. The second frame body guide portion 120 is a passage in which the second protruding portion 154 formed on the second frame body 151 of the second member 150 is disposed so as to be movable in the Z direction. One of the pair of second frame body guide portions 120 is formed on the first side frame 112 located in the +X direction. One of the pair of second frame body guide portions 120 is formed in a groove shape being open in the −X direction and extending in the Z direction. The other of the pair of second frame body guide portions 120 is formed on the first side frame 113 located in the −X direction. The other of the pair of second frame body guide portions 120 is formed in a groove shape being open in the +X direction and extending in the Z direction. The second frame body guide portion 120 is open in the +Z direction, and is configured to allow the second protruding portion 154 of the second member 150 to be inserted from the +Z direction to the −Z direction. The second frame body guide portion 120 sandwiches the second protruding portion 154 in the Y direction, thereby restricting displacement in the Y direction of the second member 150 while guiding a movement in the Z direction of the second member 150.

As illustrated in FIGS. 8 and 9, the first frame body 101 includes a pair of engagement passages 121. The engagement passage 121 is a passage in which the second engagement portion 157 formed on the second member 150 is disposed so as to be movable in the Z direction. One of the pair of engagement passages 121 is formed in the −Y direction relative to the second frame body guide portion 120 in the first side frame 112 located in the +X direction. The other of the pair of engagement passages 121 is formed in the −Y direction relative to the second frame body guide portion 120 in the first side frame 113 located in the −X direction. One of the pair of engagement passages 121 is formed in a groove shape being open in the −X direction and extending in the Z direction. The other of the pair of engagement passages 121 is formed in a groove shape being open in the +X direction and extending in the Z direction. The engagement passage 121 is open in the +Z direction, and is configured to allow the second engagement portion 157 to be inserted from the +Z direction to the −Z direction.

Figure 10:
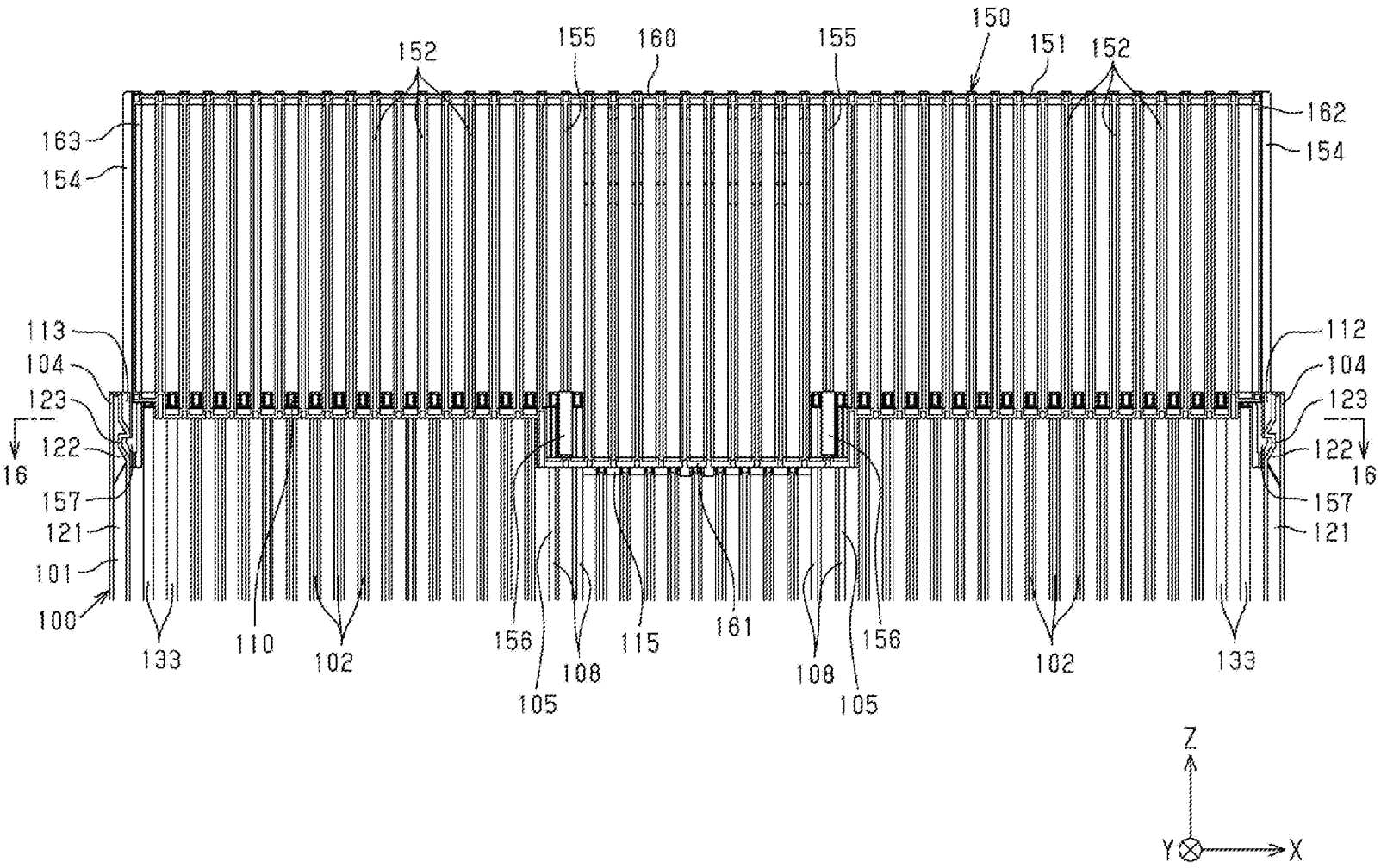
FIG. 10 is a rear view illustrating a first member and the second member when the second member is located in a second developed position.

As illustrated in FIGS. 9 and 10, the engagement passage 121 includes a second member locking portion 122 at an end portion in the +Z direction. The second member locking portion 122 includes a second member locking recessed portion 123 being recessed toward the outside of the first frame body 101 in the X direction. The second member locking portion 122 locks the second member 150 in the second developed position by the second engagement portion 157 of the second member 150 snap-engaging with the second member locking recessed portion 123 from the inside of the first frame body 101 due to a movement of the second member 150 in the +Z direction relative to the first member 100. In other words, a position in which the second engagement portion 157 of the second member 150 engages with the second member locking recessed portion 123 is also regarded as the second developed position. Note that the engagement passage 121 may be configured such that the second engagement portion 157 contacts only during the snap-engagement.

As illustrated in FIG. 6, the first rib 102 spans the first upper frame 110 and the first lower frame 111. A longitudinal direction of the first rib 102 extends along the Z direction that is the transport direction of the medium M in plan view in the +Y direction from the −Y direction and is also the movement direction of the first member 100 with respect to the housing member 50. The plurality of first ribs 102 are arranged in the X direction at predetermined intervals so as to constitute a first rib group.

Figure 11:
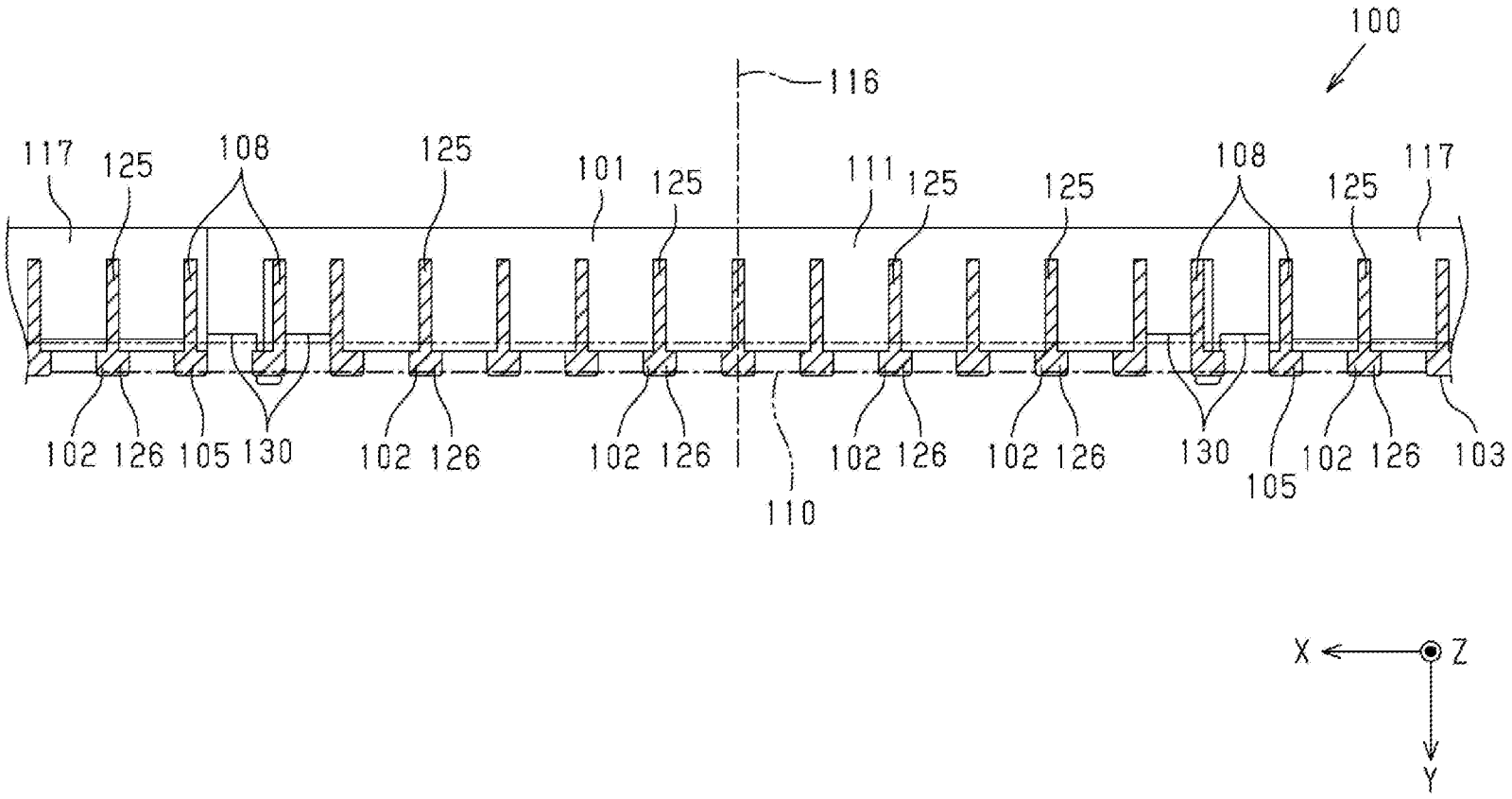
FIG. 11 is a partial cross-sectional view illustrating a cross section of a central portion taken along a 11-11 line in FIG. 6.

As illustrated in FIGS. 7 and 11, the first rib 102 includes a first rib main body 125 and a first support-surface forming portion 126. The first rib main body 125 is formed in a flat plate shape that has a transverse cross section extending with the Y direction as a longitudinal direction and extends in the Z direction. An end portion in the −Y direction of the first rib main body 125 is located in the +Y direction relative to an end portion in the −Y direction of the first lower frame 111. A length of the first rib main body 125 along the Y direction is shorter than a length of the first rib main body 125 along the Z direction.

The first support-surface forming portion 126 is integrally coupled to an end portion in the +Y direction of the first rib main body 125. The first support-surface forming portion 126 is formed so as to have a width in the X direction greater than that of the first rib main body 125 in the transverse cross section of the first rib 102 being a cross section orthogonal to the Z direction in which the first rib 102 extends. In other words, the first support-surface forming portion 126 is formed in a shape that protrudes from the end portion in the +Y direction of the first rib main body 125 toward at least one of the +X direction and the −X direction. The first rib 102 is formed in a shape that widens at the end portion in the +Y direction in the transverse cross section thereof. The first support-surface forming portion 126 forms the first support surface 103 by a portion located in the +Y direction relative to the first frame body 101. An end portion in the +Y direction of the first support-surface forming portion 126 is integrally coupled to the first upper frame 110 at the end portion in the +Z direction of the first rib 102. In FIG. 11, the first upper frame 110 is indicated by a chain double-dashed line. Further, both of the first rib main body 125 and the first support-surface forming portion 126 are integrally coupled to the first lower frame 111 at an end portion in the −Z direction of the first rib 102.

In other words, when a surface orthogonal to the transport direction (Z direction) of the medium M on the first support surface 103 is assumed to be a transverse cross section, a length of the first support-surface forming portion 126 in the orthogonal direction (X direction) orthogonal to the transport direction (Z direction) along the first support surface 103 is greater than a length of the first rib main body 125 in the orthogonal direction (X direction).

Figure 12:
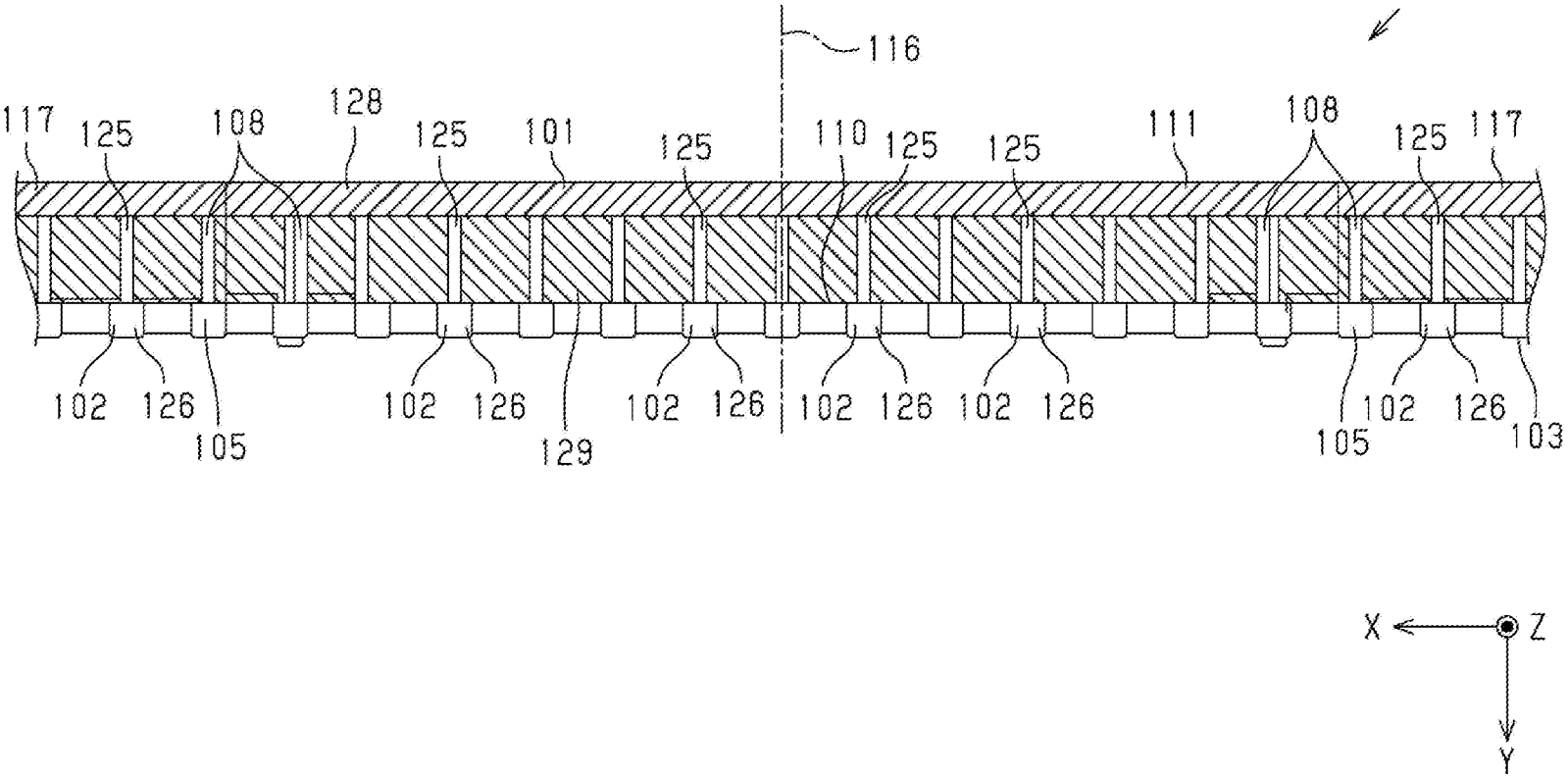
FIG. 12 is a diagram schematically illustrating a movement space of the second member in the first member.

As illustrated in FIG. 12, of a space in the +Z direction relative to the first lower frame 111, a space located in the −Y direction relative to the first rib main body 125 is a second frame body movement space 128 in which the second frame body 151 moves in the Z direction. Of the space in the +Z direction relative to the first lower frame 111, a space sandwiched by the first rib main bodies 125 adjacent to each other in the X direction constitutes a second rib movement space 129 in which the second rib 152 of the second member 150 moves in the Z direction. Note that, in FIG. 12, the second frame body movement space 128 and the second rib movement space 129 have hatching patterns different from each other.

As illustrated in FIGS. 6 and 7, the plurality of first ribs 102 include the pair of first engagement ribs 105 that engage with the pair of first rib guide portions 73 formed on the housing member 50. One of the pair of first engagement ribs 105 is located in a position in the +X direction relative to the first central line 116 indicating the center of the first member 100 in the X direction and in the position closer to the first central line 116 than the first side frame 112. In the present exemplary embodiment, one of the pair of first engagement ribs 105 is located in the +X direction relative to the first upper frame recessed portion 115 and also in the −X direction relative to the first lower frame recessed portion 117 so as to be adjacent to the first upper frame recessed portion 115 and the first lower frame recessed portion 117 in the X direction.

The other of the pair of first engagement ribs 105 is located in a position in the −X direction relative to the first central line 116 indicating the center of the first member 100 in the X direction and in the position closer to the first central line 116 than the first side frame 113. In the present exemplary embodiment, the other of the pair of first engagement ribs 105 is located in the −X direction relative to the first upper frame recessed portion 115 and also in the +X direction relative to the first lower frame recessed portion 117 so as to be adjacent to the first upper frame recessed portion 115 and the first lower frame recessed portion 117 in the X direction.

The first rib guide portion 73 sandwiches the first engagement rib 105 in the X direction, thereby guiding a movement in the Z direction of the first member 100 by the first rib guide portion 73, and also restricting displacement in the X direction of the first member 100.

Note that the "position close to the first central line 116" means that a distance L11 from the first central line 116 to the first engagement rib 105 is a distance equal to or less than ½ of a distance L12 from the first central line 116 to the first protruding portion 104. The distance L11 is a distance equal to or less than ½ of the distance L12, and thus displacement of the first member 100 in the X direction can be effectively suppressed. Note that the distance L11 is a distance equal to or less than ⅓ of the distance L12, and thus the displacement of the first member 100 in the X direction can be further effectively suppressed.

Further, as illustrated in FIG. 11, a middle-stage guide relief portion 130 that avoids interference with the first rib guide portion 73 of the housing member 50 is formed on the first lower frame 111 in a position sandwiching the first engagement rib 105 in the X direction.

Figure 13:
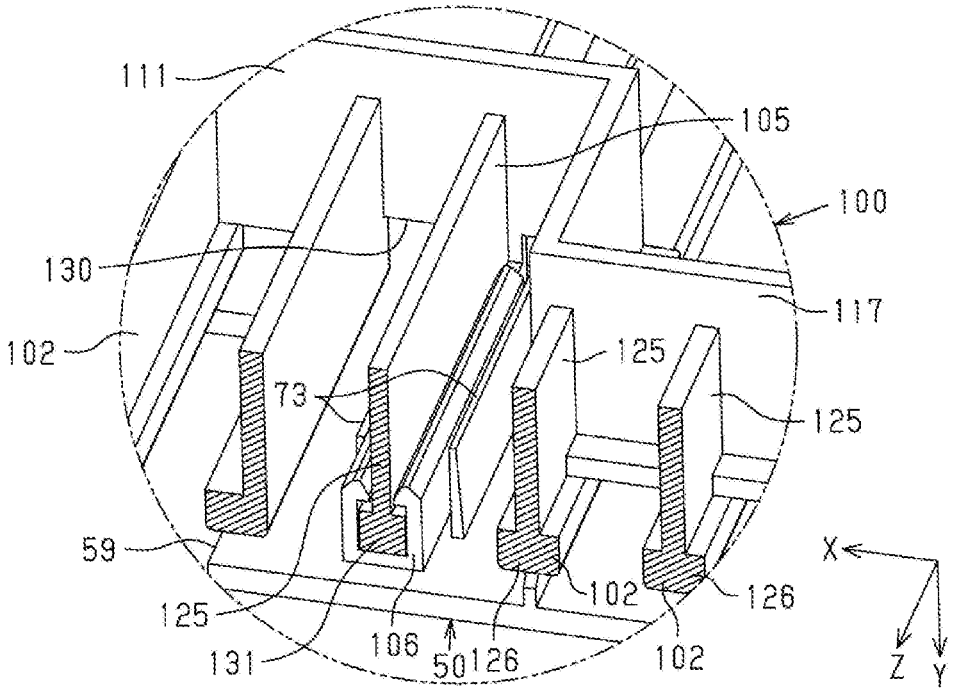
FIG. 13 is an enlarged view of a portion surrounded by a chain double-dashed line 13 in FIG. 7.

As illustrated in FIG. 13, the first low friction member 106 is attached to the first engagement rib 105. The first low friction member 106 is a low friction member having a surface with a friction coefficient lower than that of a surface of the first rib guide portion 73 and that of a surface of the first engagement rib 105. The first low friction member 106 is manufactured from, for example, a polyacetal resin (POM) or LUBMER (registered trademark).

The first engagement rib 105 includes a first attachment portion 131 to which the first low friction member 106 is attached. The first attachment portion 131 is provided at an end portion in the −Z direction of the first engagement rib 105. As illustrated in FIG. 6, the first attachment portion 131 extends in the Z direction so as to be continuous with the first support-surface forming portion 126 located in the +Z direction relative to the first attachment portion 131. The first attachment portion 131 is a portion having a width in the X direction greater than a width of the first rib main body 125 and smaller than a width of the first support-surface forming portion 126 in the transverse cross section of the first engagement rib 105.

The first low friction member 106 has a groove shape extending in the Z direction. While being attached to the first attachment portion 131, the first low friction member 106 covers a circumferential surface of the first attachment portion 131 from the +Y direction, and also engages with a step formed between the first rib main body 125 and the first attachment portion 131 in the Z direction. In other words, the first low friction member 106 is locked to the step formed between the first rib main body 125 and the first attachment portion 131 in the Z direction, thereby restricting a movement in the Z direction of the first low friction member 106.

As illustrated in FIGS. 6 to 8 and 10, the plurality of first ribs 102 include a first thin rib 133. The first thin rib 133 is the first rib 102 constituted only of the first support-surface forming portion 126 without including the first rib main body 125. The first thin rib 133 is the first rib 102 located at the end portion in the X direction of the first frame body 101. The first thin rib 133 is located outside the first lower frame recessed portion 117 of the first lower frame 111 in the X direction.

As illustrated in FIGS. 6 to 8 and 10, the first member 100 includes the pair of first engagement portions 107. One of the pair of first engagement portions 107 is located at the end portion in the −Z direction of the end portion in the +X direction. One of the pair of first engagement portion 107 is integrally coupled to the first thin rib 133 and the first side frame 112 that are located at the outermost end in the +X direction. One of the pair of first engagement portions 107 extends in the −Z direction between the first thin rib 133 and the first side frame 112 that are located at the outermost end in the +X direction.

The other of the pair of first engagement portions 107 is located at the end portion in the −Z direction of the end portion in the −X direction. The other of the pair of first engagement portions 107 is integrally coupled to the first thin rib 133 and the first side frame 113 that are located at the outermost end in the −X direction. The other of the pair of first engagement portions 107 extends in the −Z direction between the first thin rib 133 and the first side frame 113 that are located at the outermost end in the −X direction.

As illustrated in FIG. 14, the first engagement portion 107 is elastically deformed in the −Y direction by being pressed against the first member locking portion 75 in the process of the first member 100 moving toward the first developed position, and the first engagement portion 107 is then restored and snap-engages with the first member locking portion 75. The first engagement portion 107 engages with the first member locking portion 75, and thus the first member 100 is locked to the first developed position.

Second Member 150

The second member 150 will be described in more detail with reference to FIGS. 15 to 17.

Figure 15:
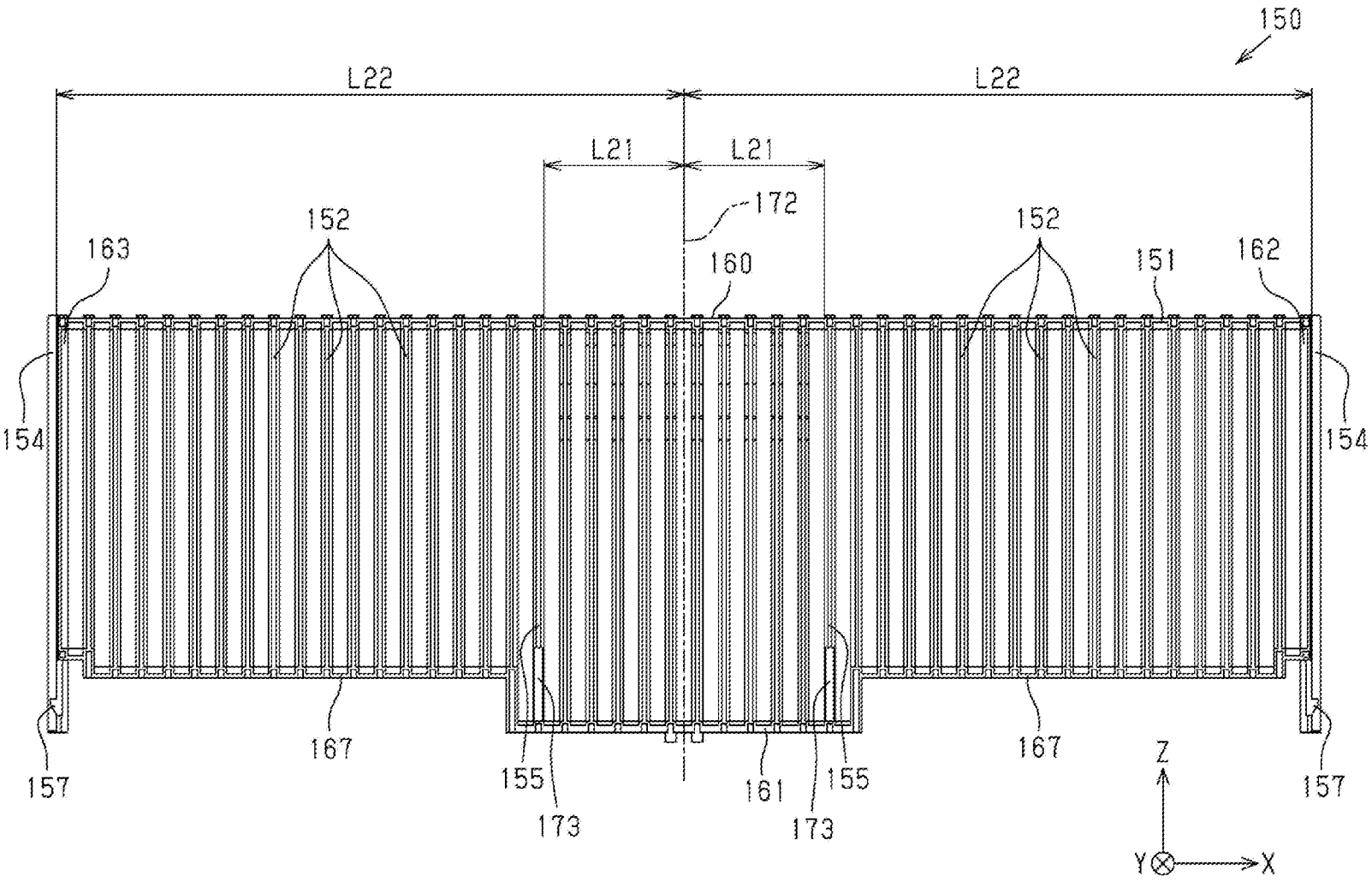
FIG. 15 is a rear view illustrating the second member.

As illustrated in FIG. 15, the second member 150 is manufactured by various molding methods using a resin material such as ABS resin, for example. A resin material having a color different from that of the first member 100 may be used for manufacturing the second member 150. The second member 150 includes the second frame body 151 and the plurality of second ribs 152. The second frame body 151 forms the outer peripheral portion of the second member 150. The second rib 152 is integrally coupled to the second frame body 151. The second frame body 151 includes a second upper frame 160, a second lower frame 161, a second side frame 162, and a second side frame 163. The second upper frame 160 is located in the +Z direction in the second frame body 151, and the second lower frame 161 is located in the −X direction in the second frame body 151. The second side frame 162 is located in the +X direction in the second frame body 151, and the second side frame 163 is located in the −X direction in the second frame body 151.

As illustrated in FIGS. 3 and 6, when the second member 150 is located in the second housing position, the second upper frame 160 is located in the −Y direction relative to the first upper frame 110. The second lower frame 161 is located in the +Z direction relative to the first lower frame 111. The second side frame 162 is located in the −X direction relative to the first side frame 112. The second side frame 163 is located in the +X direction relative to the first side frame 113.

The second upper frame 160 extends in the X direction at an end portion in the +Z direction of the second frame body 151. The second upper frame 160 moves in the Z direction on the −Y direction side relative to the first upper frame 110. When the second member 150 is located in the second housing position, the second upper frame 160 is disposed in a position overlapping a portion of the first upper frame 110 of the first member 100 except for the first upper frame recessed portion 115 from the −Y direction.

The second lower frame 161 extends in the X direction at an end portion in the −Z direction of the second frame body 151. The second lower frame 161 is disposed in the second frame body movement space 128 illustrated in FIG. 12. When the second member 150 is located in the second housing position, the second lower frame 161 is formed in a shape that conforms to the first lower frame 111 in the +Z direction relative to the first lower frame 111 of the first frame body 101. The second lower frame 161 includes a pair of second lower frame recessed portions 167 being recessed toward the +Z direction. One of the pair of second lower frame recessed portions 167 is located in the +X direction relative to the operating portion 159 illustrated in FIGS. 2 and 3. The other of the pair of second lower frame recessed portions 167 is located in the −X direction relative to the operating portion 159 illustrated in FIGS. 2 and 3. Each of the pair of second lower frame recessed portions 167 is formed in a bent shape including a plurality of bent portions. In the pair of second lower frame recessed portions 167, a load acting on the second frame body 151 is effectively dispersed. Thus, by providing the second frame body 151 with the pair of second lower frame recessed portions 167, the mechanical strength of the second frame body 151 itself can be increased.

The second side frame 162 extends along the Z direction in the +X direction of the second frame body 151, and integrally couples an end portion of the second upper frame 160 to an end portion of the second lower frame 161 in the +X direction. The second side frame 162 extends in the −Z direction farther than the coupled portion with the second lower frame 161.

The second side frame 163 extends along the Z direction in the −X direction of the second frame body 151, and integrally couples an end portion of the second upper frame 160 to an end portion of the second lower frame 161 in the −X direction. The second side frame 163 extends in the −Z direction farther than the coupled portion with the second lower frame 161.

Figure 16:
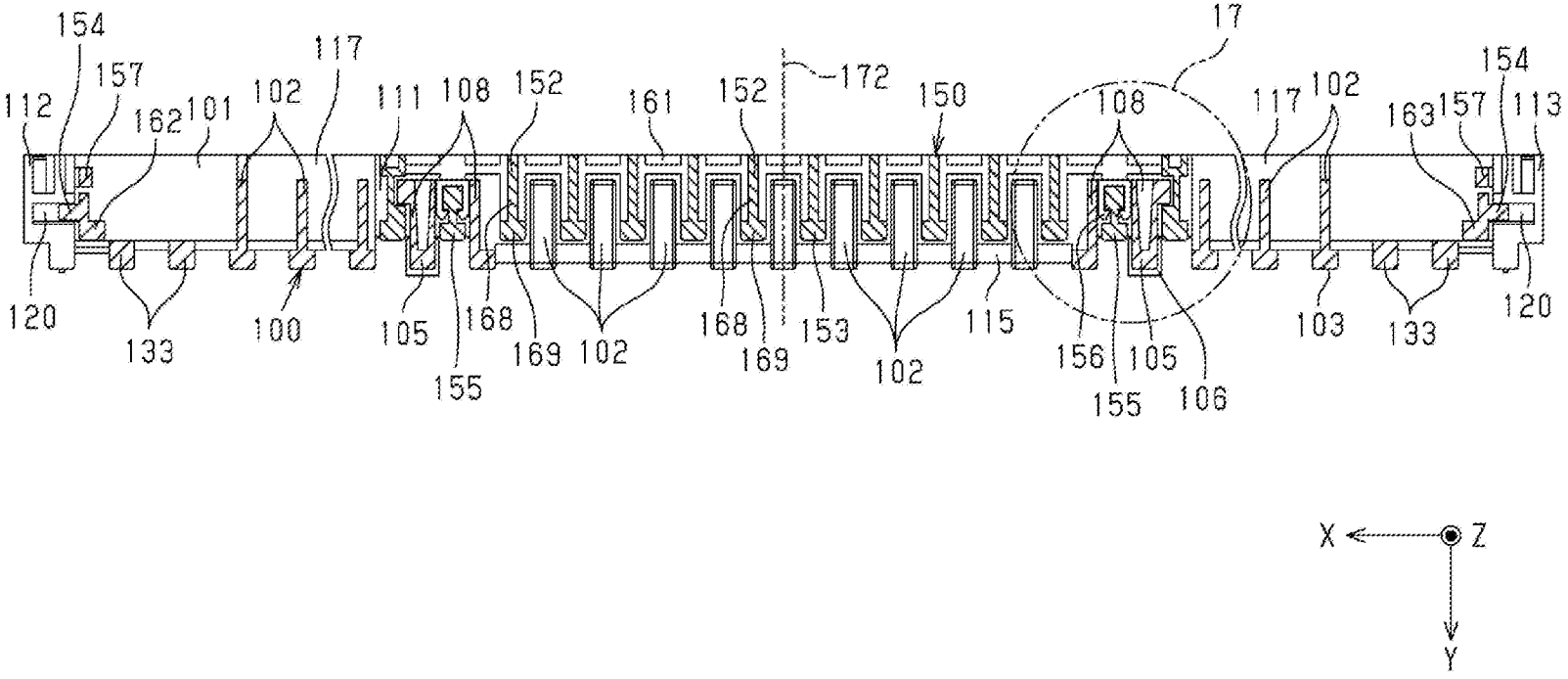
FIG. 16 is a cross-sectional view taken along a 16-16 line in FIG. 10.

As illustrated in FIGS. 15 and 16, the second frame body 151 includes the pair of second protruding portions 154. One of the pair of second protruding portions 154 is formed on the second side frame 162. One of the pair of second protruding portions 154 protrudes in the +X direction from the second side frame 162 toward the outside of the second frame body 151 in the X direction. The other of the pair of second protruding portions 154 is formed on the second side frame 163. The other of the pair of second protruding portions 154 protrudes in the −X direction from the second side frame 162 toward the outside of the second frame body 151 in the X direction. The pair of second protruding portions 154 form a protruding portion on the end surface of the second frame body 151 in the X direction, thereby constituting the end portion of the second member 150 in the X direction. When the second member 150 moves with respect to the first member 100, the second protruding portion 154 moves through the second frame body guide portion 120 formed in the first member 100. Specifically, the second protruding portion 154 moves in a position sandwiched by the second frame body guide portion 120 in the Y direction, and in a position away from the first side frames 112 and 113 of the first member 100 in the X direction. The second protruding portion 154 contacts the second frame body guide portion 120, and thus displacement of the second member 150 in the Y direction relative to the first member 100 is restricted by the end portion in the X direction.

As illustrated in FIGS. 9, 10, and 15, the second frame body 151 includes the pair of second engagement portions 157. One of the pair of second engagement portions 157 is formed on the second side frame 162 of the second frame body 151. The other of the pair of second engagement portions 157 is formed on the second side frame 163 of the second frame body 151. The second engagement portion 157 is located in the −Y direction relative to the second protruding portion 154, and is formed in a cantilever shape extending in the −Z direction from the coupled portion between the second side frames 162 and 163 and the second lower frame 161. The second engagement portion 157 is elastically deformed into the inside of the second frame body 151 in the X direction by being pressed against the second member locking portion 122 in the process of the second member 150 moving toward the second developed position, and the second engagement portion 157 is then restored and snap-engages with the second member locking portion 122. The second engagement portion 157 engages with the second member locking portion 122, and thus the second member 150 is locked to the second developed position.

As illustrated in FIGS. 3, 10, and 15, the second rib 152 spans between the second upper frame 160 and the second lower frame 161. The second rib 152 extends along the Z direction that is the transport direction of the medium M in plan view in the +Y direction from the −Y direction and is also the movement direction of the second member 150 with respect to the first member 100. The second ribs 152 are arranged in the X direction at predetermined intervals so as to constitute a second rib group. The second rib 152 is disposed in the space between the first rib main bodies 125 adjacent to each other in the X direction, namely, the second rib movement space 129 illustrated in FIG. 12. The second rib 152 and the first rib 102 are alternately arranged so as to fill gaps in the X direction in plan view in the −Y direction from the +Y direction.

Figure 17:
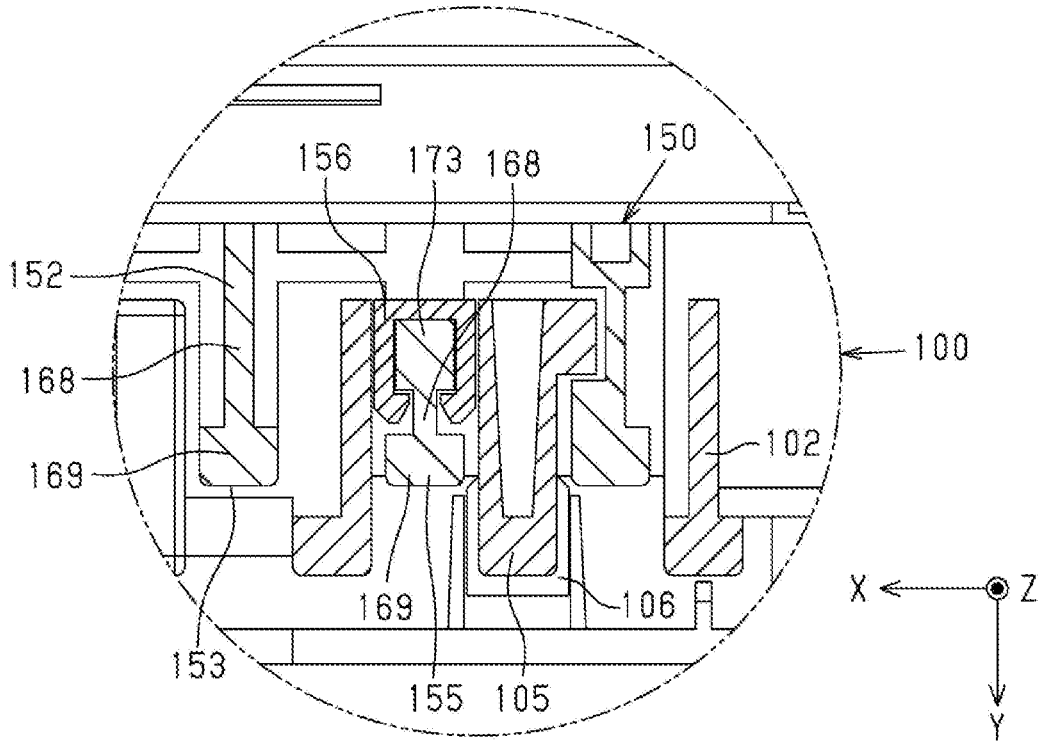
FIG. 17 is an enlarged view of a portion surrounded by a chain double-dashed line 17 in FIG. 16.

As illustrated in FIGS. 16 and 17, the second rib 152 includes a second rib main body 168 and a second support-surface forming portion 169. The second rib main body 168 is formed in a flat plate shape that has a transverse cross section with a longitudinal direction set to the Y direction and extends in the Z direction. The second support-surface forming portion 169 is integrally coupled to an end portion in the +Y direction of the second rib main body 168. The second support-surface forming portion 169 is formed so as to have a width in the X direction greater than that of the second rib main body 168 in the transverse cross section of the second rib 152 being a cross section of the second rib 152 in a direction orthogonal to the Z direction. In other words, the second support-surface forming portion 169 is formed in a shape that protrudes from the end portion in the +Y direction of the second rib main body 168 toward at least one of the +X direction and the −X direction. In other words, the second rib 152 extending in the Z direction is formed in a shape that widens at the end portion in the +Y direction in the transverse cross section thereof. The second support-surface forming portion 169 forms the second support surface 153 by a portion located in the +Y direction relative to the second frame body 151.

In other words, when a surface orthogonal to the transport direction (Z direction) of the medium M on the second support surface 153 is assumed to be a transverse cross section, a length of the second support-surface forming portion 169 in the orthogonal direction (X direction) orthogonal to the transport direction (Z direction) along the second support surface 153 is greater than a length of the second rib main body 168 in the orthogonal direction (X direction).

As illustrated in FIGS. 3, 15, and 16, the plurality of second ribs 152 include the pair of second engagement ribs 155 that engage with the pair of second rib guide portions 108 of the first member 100. One of the pair of second engagement ribs 155 is located in a position in the +X direction relative to a second central line 172 indicating the center of the second member 150 in the X direction and in the position closer to the second central line 172 than the second side frame 162. In the present exemplary embodiment, as illustrated in FIG. 3, one of the pair of second engagement ribs 155 is located in a position in the +X direction relative to the first upper frame recessed portion 115 of the first upper frame 110 and in the −X direction relative to the first lower frame recessed portion 117. One of the pair of second engagement ribs 155 is located in the −X direction relative to the first engagement rib 105 in plan view in the −Y direction from the +Y direction, and is also located in a position adjacent to the first engagement rib 105.

The other of the pair of second engagement ribs 155 is located in a position in the −X direction relative to the second central line 172 indicating the center of the second member 150 in the X direction and in the position closer to the second central line 172 than the second side frame 162. In the present exemplary embodiment, the other of the pair of second engagement ribs 155 is located in the −X direction relative to the first upper frame recessed portion 115 of the first upper frame 110 and in the +X direction relative to the first lower frame recessed portion 117. The other of the pair of second engagement ribs 155 is located in the +X direction relative to the first engagement rib 105 in plan view in the −Y direction from the +Y direction, and is also located in a position adjacent to the first engagement rib 105.

The second rib guide portion 108 of the first member 100 sandwich the second engagement rib 155 in the X direction, thereby guiding a movement in the Z direction of the second member 150 by the second rib guide portion 108, and also restricting displacement in the X direction of the second member 150.

Note that the "position close to the second central line 172" means that a distance L21 from the second central line 172 to the second engagement rib 155 is equal to or less than ½ of a distance L22 from the second central line 172 to the second protruding portion 154. The distance L21 is a distance equal to or less than ½ of the distance L22, and thus displacement of the second member 150 in the X direction can be effectively suppressed. The distance L21 is a distance equal to or less than ⅓ of the distance L22, and thus the displacement of the second member 150 in the X direction can be further effectively suppressed.

As illustrated in FIGS. 16 and 17, the second low friction member 156 is attached to the second engagement rib 155. The second low friction member 156 is a low friction member having a surface with a friction coefficient lower than that of a surface of the first rib 102 that constitutes the second rib guide portion 108 and that of a surface of the second engagement rib 155. The second low friction member 156 is manufactured from, for example, a polyacetal resin (POM) and LUBMER (registered trademark) similarly to the first low friction member 106.

The second engagement rib 155 includes a second attachment portion 173 to which the second low friction member 156 is attached. The second attachment portion 173 is provided at an end portion in the −Z direction of the second engagement rib 155. The second attachment portion 173 extends in the Z direction in the second rib movement space 129 illustrated in FIG. 12 so as to be continuous with the second rib main body 168. The second attachment portion 173 is a portion having a width in the X direction greater than that of the second rib main body 168 and smaller than that of the second support-surface forming portion 169 in the transverse cross section of the second engagement rib 155.

The second low friction member 156 has a groove shape extending in the Z direction. When being attached to the second attachment portion 173, the second low friction member 156 covers a circumferential surface of the second attachment portion 173 from the −Y direction, and also engages with a step formed between the second rib main body 168 and the second attachment portion 173 in the Z direction. In other words, the second low friction member 156 is locked to the step formed between the second rib main body 168 and the second attachment portion 173 in the Z direction, thereby restricting a movement in the Z direction of the second low friction member 156.

Method for Assembling Feeding Tray 32

Next, a method for assembling the feeding tray 32 having the above-described medium supporting structure of the three-stage structure will be described. The feeding tray 32 is assembled by assembling the first member 100 to the housing member 50 and assembling the second member 150 to the first member 100.

A method for assembling the first member 100 to the housing member 50 will be described. Note that the first member 100 may be assembled to the housing member 50 pivotally supported by the main body 31 of the recording device 30, or may be assembled to the housing member 50 before being pivotally supported by the main body 31 of the recording device 30.

In the assembly of the first member 100 to the housing member 50, after the first low friction member 106 is attached to the first engagement rib 105 of the first member 100, a position adjustment of the first member 100 with respect to the housing member 50 is performed. In the position adjustment of the first member 100, a position of the first member 100 is adjusted such that the first support surface 103 is parallel to the device-side support surface 51 of the housing member 50. Further, a position of the first member 100 is adjusted such that the first engagement rib 105 is located in the +Z direction relative to the first rib guide portion 73 of the housing member 50 and the first protruding portion 104 is located in the +Z direction relative to the first frame body guide portion 69 of the housing member 50 while maintaining the device-side support surface 51 and the first support surface 103 in a parallel state. At this time, the first engagement portion 107 is located in the +Z direction relative to the first member locking portion 75 of the housing member 50. Further, the first member 100 is located in the +Z direction relative to the housing port 66 of the housing member 50.

After the position adjustment, the first member 100 is inserted into the housing port 66 of the housing member 50 in the −Z direction. In this way, the first engagement rib 105 engages with the first rib guide portion 73, and the first protruding portion 104 engages with the first frame body guide portion 69. Then, when the first member 100 is inserted until the first engagement portion 107 of the first member 100 is located in the −Z direction relative to the first member locking portion 75 of the housing member 50, the assembly of the first member 100 to the housing member 50 is completed.

The first member 100 assembled to the housing member 50 is configured to be movable along the Z direction between the first housing position in which the first support surface 103 is located in the −Y direction relative to the device-side support surface 51 of the housing member 50 and the first developed position in which the first support surface 103 is located in the +Z direction relative to the housing member 50. The first engagement portion 107 engages with the first member locking portion 75 formed on the housing member 50 in the process of the first member 100 moving from the first housing position to the first developed position, and thus the first member 100 is locked in the first developed position.

A method for assembling the second member 150 to the first member 100 will be described. Note that the second member 150 may be assembled to the first member 100 assembled to the housing member 50, or may be assembled to the first member 100 before being assembled to the housing member 50.

In the assembly of the second member 150 to the first member 100, after the second low friction member 156 is attached to the second engagement rib 155 of the second member 150, a position adjustment of the second member 150 with respect to the first member 100 is performed. In the position adjustment of the second member 150, a position of the second member 150 is adjusted such that the second support surface 153 is parallel to the first support surface 103 of the first member 100. Further, a position of the second member 150 is adjusted such that the second engagement rib 155 is located in the +Z direction relative to the second rib guide portion 108 of the first member 100 and the second protruding portion 154 is located in the +Z direction relative to the second frame body guide portion 120 of the first member 100 while maintaining the first support surface 103 and the second support surface 153 in a parallel state.

At this time, the second engagement portion 157 is located in the +Z direction relative to the engagement passage 121 of the first member 100. The second lower frame 161 is located in the +Z direction relative to the second frame body movement space 128 of the first member 100. The second rib 152 is located in the +Z direction relative to the second rib movement space 129 of the first member 100.

After the position adjustment, the second member 150 is inserted into the first member 100 in the −Z direction. In this way, the second engagement rib 155 engages with the second rib guide portion 108, and the second protruding portion 154 also enters the second frame body guide portion 120. Then, when the second member 150 is inserted until the second engagement portion 157 of the second member 150 is located in the −Z direction relative to the second member locking portion 122 of the first member 100, the assembly of the second member 150 to the first member 100 is completed.

The second member 150 assembled to the first member 100 is configured to be movable along the Z direction between the second housing position in which the second support surface 153 is located in the −Y direction relative to the first support surface 103 of the first member 100 and the second developed position in which the second support surface 153 is located in the +Z direction relative to the first member 100. The second engagement portion 157 engages with the second member locking portion of the first member 100 in the process of the second member 150 moving from the second housing position to the second developed position, and thus the second member 150 is locked in the second developed position.

The feeding tray 32 assembled in this manner shifts to the developed state when the operating unit 159 of the second member 150 is operated in the +Z direction with the feeding tray 32 in the housing state, and thus the second member 150 and the first member 100 are sequentially pulled out of the housing member 50. Further, the feeding tray 32 shifts to the housing state when the second member 150 is operated in the −Z direction with the feeding tray 32 in the developed state, and thus the first member 100 and the second member 150 are housed in the housing member 50.

The functions and effects of the exemplary embodiment described above will be described.

(1) The first member 100 coupled to the housing member 50 includes the first frame body 101 that forms the outer peripheral portion of the first member 100, and the plurality of first ribs 102 that spans the first frame body 101 and forms the first support surface 103. Further, the second member 150 coupled to the first member 100 includes the second frame body 151 that forms the outer peripheral portion of the second member 150, and the plurality of second ribs 152 that spans the second frame body 151 and forms the second support surface 153.

Figure 18:
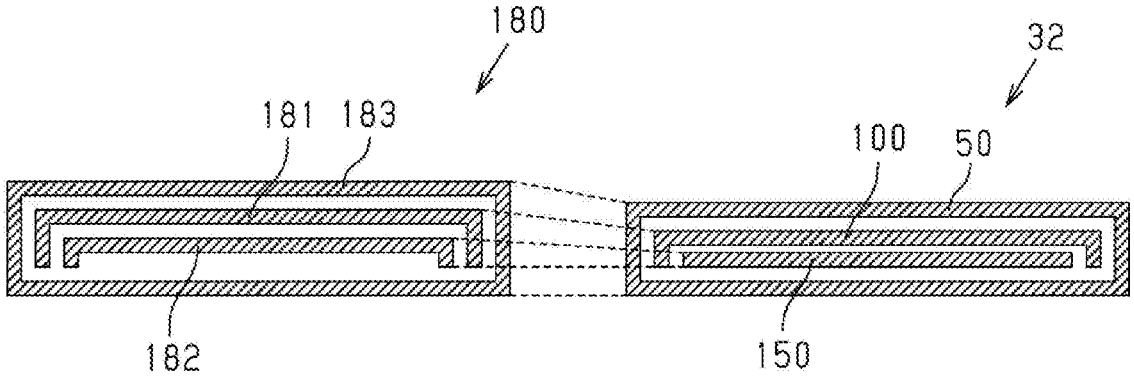
FIG. 18 is a diagram schematically illustrating a difference in thickness between a feeding tray according to one exemplary embodiment and a comparison feeding tray.

According to such a configuration, as illustrated in FIG. 18, a reduction in thickness of the feeding tray 32 can be achieved while securing the same mechanical strength as that of a comparison feeding tray 180 including a first tray 181 having a flat plat shape as a first member, a second tray 182 having a flat plate shape as a second member, and a third tray 183 having a box shape as a third member. In the feeding tray 32, the second member 150 is constituted of the second frame body 151 and the second rib 152, and thus the same mechanical strength as that of the second tray 182 can be acquired even when the second member 150 is thinner than the second tray 182. Further, the first member 100 is constituted of the first frame body 101 and the first rib 102, and thus the same mechanical strength as that of the first tray 181 can be acquired even when the first member 100 is thinner than the first tray 181. Thus, the housing member 50 that houses the first member 100 and the second member 150 can also be thinner than the third tray 183.

In other words, the first member 100 and the second member 150 are respectively constituted of the frame body 101 and the plurality of ribs 102, and the frame body 151 and the plurality of ribs 152. Thus, an inner portion of the frame bodies 101 and 151 is reinforced by the plurality of ribs 102 and 152, and both end portions of the plurality of ribs 102 and 152 are reinforced by the frame bodies 101 and 151. By the interaction between the frame body and the plurality of ribs, a reduction in thickness and weight of each of the first member 100 and the second member 150 can be achieved while securing the mechanical strength thereof. In this way, a reduction in thickness of the first member 100 that houses the second member 150 and a reduction in thickness of the housing member 50 that houses the first member 100 and the second member 150 can be achieved. As a result, a reduction in thickness and weight of the feeding tray 32 having the three-stage structure constituted of the housing member 50, the first member 100, and the second member 150 can be achieved while securing the mechanical strength. Further, a reduction in size of the recording device 30 can be achieved based on the reduction in thickness and weight, and an appearance of the feeding tray 32 constituted of only a member having a flat plate shape can be differentiated.

(2) The first rib 102 of the first member 100 includes the first rib main body 125, and the first support-surface forming portion 126 having a width in the X direction greater than that of the first rib main body 125 in the transverse cross section of the first rib 102. Further, the second rib 152 of the second member 150 includes the second rib main body 168, and the second support-surface forming portion 169 having a width in the X direction greater than that of the second rib main body 168 in the transverse cross section of the second rib 152.

According to such a configuration, the mechanical strength of each of the ribs 102 and 152 can be effectively increased while achieving a reduction in thickness and weight of each of the first member 100 and the second member 150. As a result, the mechanical strength of each of the first member 100 and the second member 150 can be effectively increased. Further, the support-surface forming portions 126 and 169 are wider than the rib main bodies 125 and 168, and thus the support surfaces 103 and 153 can be increased while increasing the mechanical strength of each of the ribs 102 and 152. Furthermore, since the rib main bodies 125 and 168 are located on the rear surface side of the support-surface forming portions 126 and 169 in a front view of the feeding tray 32, the design property of the feeding tray 32 in the developed state can be increased.

(3) The first rib 102 and the second rib 152 extend in the Z direction being the transport direction of the medium M on the feeding tray 32. According to such a configuration, for each of the first member 100 and the second member 150, the medium M and the ribs 102 and 152 can be less likely to interfere with each other when the medium M is disposed on the feeding tray 32 and when the medium M is transported by the main body 31 of the recording device 30.

(4) The first member 100 and the second member 150 move in the Z direction being the transport direction of the medium M on the feeding tray 32. According to such a configuration, a region in which the medium M can be supported can be increased in the transport direction of the medium M by shifting the feeding tray 32 to the developed state. As a result, a degree of flexibility in the medium M that can be supported by the feeding tray 32 can be increased.

(5) The housing member 50 includes the first rib guide portion 73 that restricts displacement in the X direction of the first member 100 while guiding a movement in the Z direction of the first member 100 by engaging with the first engagement rib 105 being one of the first ribs 102. In other words, the housing member 50 guides the movement of the first member 100 in the Z direction and restricts the displacement of the first member 100 in the X direction by using the first rib 102.

The first member 100 includes the second rib guide portion 108 that restricts displacement in the X direction of the second member 150 while guiding a movement in the Z direction of the second member 150 by engaging with the second engagement rib 155 being the second rib 152. In other words, the first member 100 guides the movement of the second member 150 in the Z direction and restricts the displacement of the second member 150 in the X direction by using the second rib 152.

According to such a configuration, it is not necessary to separately provide each of the first member 100 and the second member 150 with a portion related to guiding in the Z direction and a portion related to a restriction on displacement in the X direction. As a result, the configuration of the first member 100 and the second member 150 can be simplified.

Further, since the first rib 102 and the second rib 152 overlap each other in the X direction, the first member 100 can increase the mechanical strength by using an occupied space of the second member 150, and the second member 150 can increase the mechanical strength by using an occupied space of the first member 100. In this way, a reduction in thickness and weight of each of the first member 100 and the second member 150 can be effectively achieved while securing the mechanical strength.

(6) The first low friction member 106 is interposed between the first rib guide portion 73 and the first engagement rib 105. Further, the second low friction member 156 is interposed between the second rib guide portion 108 and the second engagement rib 155.

According to such a configuration, the frictional force generated when each of the first member 100 and the second member 150 moves can be reduced. As a result, a movement of the first member 100 with respect to the housing member 50 and a movement of the second member 150 with respect to the first member 100 can be performed smoothly.

(7) The housing member 50 includes the first rib guide portions 73 that separately guide each of the pair of first engagement ribs 105 located in positions sandwiching the first central line 116 of the first member 100 in the X direction. Further, the first member 100 includes the second rib guide portions 108 that separately guide each of the pair of second engagement ribs 155 located in positions sandwiching the second central line 172 of the second member 150 in the X direction. According to such a configuration, guiding in the Z direction and a restriction on displacement in the X direction can be performed at a plurality of places of each of the first member 100 and the second member 150, and rattling so as to rotate with the Y direction as an axis can be effectively suppressed.

(8) One of the pair of first engagement ribs 105 is located in a position in the +X direction relative to the first central line 116 and in the position closer to the first central line 116 than the first side frame 112. The other of the pair of first engagement ribs 105 is located in a position in the −X direction relative to the first central line 116 and in the position closer to the first central line 116 than the first side frame 113. According to such a configuration, displacement in the X direction of each of the first member 100 and the second member 150 can be effectively suppressed, and rattling so as to rotate with the Y direction as an axis can be effectively suppressed.

(9) Displacement in the Y direction of the first member 100 is restricted by engagement between the pair of first protruding portions 104 protruding outward in the X direction from the first frame body 101 and the first frame body guide portions 69 of the housing member 50. Displacement in the Y direction of the second member 150 is restricted by engagement between the pair of second protruding portions 154 protruding outward in the X direction from the second frame body 151 and the second frame body guide portions 120 formed on the first frame member 101 of the first member 100. According to such a configuration, the displacement in the Y direction is restricted by the protruding portions 104 and 154 protruding outward in the X direction, and thus an effect of the portion that restricts the displacement in the Y direction on a reduction in thickness can be reduced for each of the housing member 50, the first member 100, and the second member 150.

(10) The feeding tray 32 is configured to be able to support the medium by the housing member 50, the first member 100, and the second member 150. According to such a configuration, a load associated with the support of the medium M of the housing member 50 and the first member 100 is dispersed in both of the housing member 50 and the first member 100. Further, a load associated with the support of the medium M of the first member 100 and the second member 150 is dispersed in both of the first member 100 and the second member 150. In this way, a load acting on various engagement portions of the housing member 50, the first member 100, and the second member 150 can be effectively dispersed.

(11) Since the first rib 102 and the second rib 152 have colors different from each other, a failure of the second member 150 to be pulled out of the first member 100 is easily visually confirmed. Further, the design property of the feeding tray 32 can also be increased.

(12) The feeding tray 32 has the housing state in which the first member 100 and the second member 150 are housed in the housing member 50 having the box shape. According to such a configuration, a foreign matter can be prevented from entering various engagement portions by bringing the feeding tray 32 into the housing state.

(13) The first frame body 101 and the second frame body 151 are formed in a polygonal shape having the plurality of bent portions bent toward the inside and the outside of the frame body by various recessed portions. According to such a configuration, a load acting on the frame body is effectively dispersed in the bent portion, and thus a reduction of the first frame body 101 and the second frame body 151 in thickness and weight can be achieved while securing the mechanical strength.

(14) The first engagement rib 105 of the first member 100 extends in the Z direction in a position adjacent to the first lower frame recessed portion 117 in the X direction. In other words, the first engagement rib 105 extends in the Z direction in a position adjacent in the X direction to the bent portion of the first lower frame recessed portion 117 that is a portion having high mechanical strength in the first member 100. According to such a configuration, even when a load associated with a restriction on displacement of the first member 100 in the X direction acts on the first engagement rib 105, the load acting on the first engagement rib 105 can be suppressed because the load is dispersed in the bent portion of the first lower frame recessed portion 117 having high mechanical strength. In this way, a degree of freedom in shape of the first engagement rib 105, and specifically, a degree of freedom in the attachment portion of the first low friction member 106 can be increased.

(15) The first low friction member 106 engages with the step between the first rib main body 125 and the first attachment portion 131. In this way, the first low friction member 106 is less likely to be detached from the first engagement rib 105.

(16) The second rib guide portion 108 of the first member 100 is constituted of the pair of first ribs 102 extending in the Z direction in positions adjacent to the first upper frame recessed portion 115 in the X direction. In other words, the second rib guide portion 108 is constituted of the pair of first ribs 102 extending in the Z direction in positions adjacent in the X direction to the bent portion of the first upper frame recessed portion 115 that is a portion having high mechanical strength in the first member 100. According to such a configuration, even when a load associated with a restriction on displacement of the second member 150 in the X direction acts on the second rib guide portion 108 with the second member 150 located in the second developed position, the load acting on the second rib guide portion 108 can be effectively suppressed because the load is dispersed in the bent portion of the first upper frame recessed portion 115 having high mechanical strength.

(17) One of the first ribs 102 that constitutes the second rib guide portion 108 of the first member 100 is the first engagement rib 105 described above. Thus, even when a load associated with a restriction on displacement of the second member 150 in the X direction acts on the first rib 102 constituting the second rib guide portion 108, the load acting on the first rib 102 can be suppressed.

(18) The first thin rib 133 spans the first upper frame 110 and the first lower frame 111 at the end portion in the X direction of the first frame body 101. In other words, the first thin rib 133 is the first rib 102 that spans the corner portion of the first frame body 101, namely, a portion of the first frame body 101 having high mechanical strength. Thus, a load acting on the first thin rib 133 is effectively dispersed in the first frame body 101. Further, the first thin rib 133 does not directly get involved in a restriction on displacement of the first member 100 and the second member 150. For these reasons, the mechanical strength needed for the first thin ribs 133 is smaller than that of the other first ribs 102. Thus, even when the first thin rib 133 is constituted of only the first support-surface forming portion 126 without including the first rib main body 125, a problem with the mechanical strength is less likely to occur. A reduction in weight of the first member 100 and thus a reduction in weight of the feeding tray 32 can be achieved by setting the first thin rib 133. Further, a degree of difficulty in forming the second frame body guide portion 120 and the engagement passage 121 can also be reduced.

(19) The second engagement rib 155 of the second member 150 extends in the Z direction in a position adjacent to the second lower frame recessed portion 167 in the X direction. In other words, the second engagement rib 155 extends in the Z direction in a position adjacent in the X direction to the bent portion of the second lower frame recessed portion 167 that is a portion having high mechanical strength in the second member 150. According to such a configuration, even when a load associated with a restriction on displacement of the second member 150 in the X direction acts on the second engagement rib 155, the load acting on the second engagement rib 155 can be suppressed because the load is dispersed in the bent portion of the second lower frame recessed portion 167 having high mechanical strength. In this way, a degree of freedom in shape of the second engagement rib 155, and specifically, a degree of freedom in the attachment portion of the second low friction member 156 can be increased.

(20) The second low friction member 156 engages with the step between the second rib main body 168 and the second attachment portion 173. In this way, the second low friction member 156 is less likely to be detached from the second engagement rib 155.

The exemplary embodiment described above may be modified as follows. The exemplary embodiment described above and the following modified examples may be implemented in combination within a range in which a technical contradiction does not arise.

- The medium supporting structure of the three-stage structure constituted of the housing member 50, the first member 100, and the second member 150 may be applied to the discharge tray 36.
- In the feeding tray 32 having the medium supporting structure of the three-stage structure, the housing member 50 may not support the medium M.
- The medium supporting structure is not limited to the three-stage structure constituted of the housing member 50, the first member 100, and the second member 150. Further, for example, the medium supporting structure may be a two-stage structure constituted of the housing member 50 and the first member 100. For example, the medium supporting structure may be a two-stage structure constituted of the first member 100 and the second member 150 by directly coupling the first member 100 to the main body 31 of the recording device 30, namely, a two-stage structure constituted of a member including a frame body and a rib. In this case, the first member 100 may be configured to be rotatably coupled to the main body 31 of the recording device 30 with an axis along the X direction as a rotation axis, or may not support the medium M.

The medium supporting structure may be a three or more multi-stage structure including a second housing member that can house a two-stage structure portion constituted of the housing member 50 and the first member 100.

The medium supporting structure may be a three or more multi-stage structure including a member that is a member including a frame body forming an outer peripheral portion and a plurality of ribs spanning the frame body and extending in the Z direction, and that can house a two-stage structure portion constituted of the first member 100 and the second member 150. In such a case, the first rib 102 of the first member 100, the second rib 152 of the second member 150, and the rib of the member may be periodically arranged in the X direction. For example, when the rib of the member is assumed to be a third rib, the first rib 102, the second rib 152, and the third rib may be periodically arranged in the order of the third rib, the first rib 102, the second rib 152, and the first rib 102 in the +X direction, or may be periodically arranged in the order of the third rib, the first rib 102, and the second rib 152 in the +X direction.

The first rib 102 and the second rib 152 may be formed in the same color.

The second rib 152 is not limited to a rib including the second rib main body 168 and the second support-surface forming portion 169 that is wider than the second rib main body 168. For example, the second rib 152 may be constituted of the second rib main body 168 and a second support-surface forming portion that is narrower than the second rib main body 168. Further, a shape in a transverse cross section of the second rib 152 may be a protruding polygonal shape or a circular shape.

The first rib 102 is not limited to a rib including the first rib main body 125 and the first support-surface forming portion 126 that is wider than the first rib main body 125. For example, the first rib 102 may be constituted of the first rib main body 125 and a first support-surface forming portion that is narrower than the first rib main body 125. Further, a shape in a transverse cross section of the first rib 102 may be a polygonal shape or a circular shape.

The first member 100 is not limited to a configuration including the first frame body 101 and the first rib 102. For example, the first member 100 may be formed in a flat plate shape including various engagement portions, such as the front wall 60 of the housing member 50.

The first member 100 includes the first protruding portion 104 that forms a protruding portion on the end surface of the first frame body 101 in the X direction. The first member 100 is not limited thereto, and the first member 100 may include the first protruding portion 104 that forms a recessed portion on the end surface of the first frame body 101 in the X direction. In such a configuration, the first frame body guide portion 69 formed in the housing member 50 is constituted of a protruding portion that protrudes inward in the X direction.

The second member 150 includes the second protruding portion 154 that forms a protruding portion on the end surface of the second frame body 151 in the X direction. The second member 150 is not limited thereto, and the second member 150 may include the second protruding portion 154 that forms a recessed portion on the end surface of the second frame body 151 in the X direction. In such a configuration, the second frame body guide portion 120 formed on the first member 100 is constituted of a protruding portion that protrudes inward in the X direction.

In the first member 100, one of the pair of first engagement ribs 105 may be located in the +X direction in the first member 100, and may be located in a position away from the first central line 116. The other of the pair of first engagement ribs 105 may be located in the −X direction in the first member 100, and may be located in a position away from the first central line 116.

In the second member 150, one of the pair of second engagement ribs 155 may be located in the +X direction in the second member 150, and may be located in a position away from the second central line 172. The other of the pair of second engagement ribs 155 may be located in the −X direction in the second member 150, and may be located in a position away from the second central line 172.

The first rib guide portion 73 of the housing member 50 may be configured to guide the movement of the first member 100 by engaging with the first rib 102. Thus, the first rib guide portion 73 may be configured to guide the first member 100 by sandwiching the first rib 102 in the X direction, or may be configured to guide the first member 100 by being sandwiched in the X direction by the pair of first ribs 102. Further, the first rib guide portion 73 may be configured to guide the first rib 102 at one place, or may be configured to guide the first rib 102 at three or more places.

The second rib guide portion 108 of the first member 100 may be configured to guide the movement of the second member 150 by the engagement between the first rib 102 and the second rib 152. Thus, the second rib guide portion 108 may be configured to guide the second rib 152 at one place, or may be configured to guide the second rib 152 at three or more places.

The first rib guide portion 73 of the housing member 50 may be configured to be able to directly contact the first rib 102.

The second rib guide portion 108 of the first member 100 may be configured to be able to directly contact the second rib 152.

The housing member 50 may be configured to restrict the movement of the first member 100 in the Z direction and the displacement of the first member 100 in the X direction without using the first rib 102. For example, the housing member 50 may be configured to restrict the displacement of the first member in the X direction by forming, on the first frame body guide portion 69, a portion that contacts the first protruding portion 104 of the first member from the outside in the X direction.

The first member 100 may be configured to restrict the movement of the second member 150 in the Z direction and the displacement of the second member 150 in the X direction without using the second rib 152. For example, the first member 100 may be configured to restrict the displacement of the second member in the X direction by forming, on the second frame body guide portion 120, a portion that contacts the second protruding portion 154 of the second member 150 from the outside in the X direction.

The movement direction of the first member 100 and the second member 150 may be set to a direction intersecting the transport direction of the medium M.

The first rib 102 may extend in the direction intersecting the transport direction of the medium M on the first support surface 103.

The second rib 152 may extend in the direction intersecting the transport direction of the medium M on the second support surface 153.

The medium supporting structure may be, for example, a configuration in which the first member 100 is rotatably supported with an axis along the X direction as a rotation shaft with respect to the housing member 50. In this case, the housing member 50 is formed in a shape having a housing recessed portion in which the first member 100 is housed, instead of a box shape. The housing recessed portion is achieved by, for example, replacing a portion corresponding to the device-side support surface 51 of the housing member 50 with an opening.

The discharge tray 36 having the medium supporting structure of the two-stage structure will be described with reference to FIGS. 19 to 23.

Figure 19:
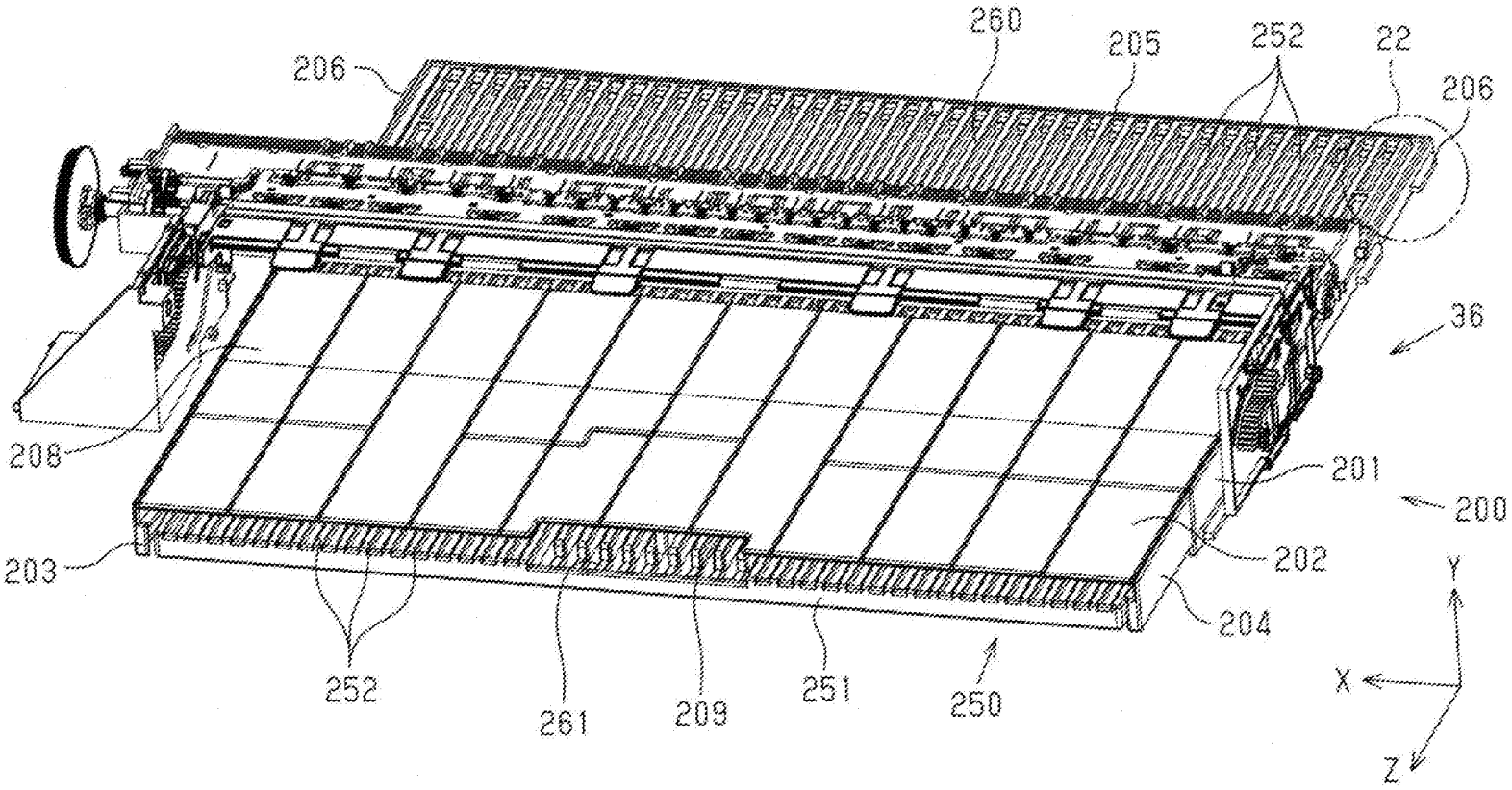
FIG. 19 is a perspective view illustrating a discharge tray in a modified example.

FIG. 19 is a front perspective view of the discharge tray 36. An X axis, a Y axis, and a Z axis described in FIG. 19 are three axes that are set for the discharge tray 36 and are orthogonal to one another. Directions indicated by arrows indicating the X axis, the Y axis, and the Z axis indicate positive directions along the X axis, the Y axis, and the Z axis, respectively. The positive directions along the X axis, the Y axis, and the Z axis are indicated by an +X direction, a +Y direction, and a +Z direction, respectively. Directions opposite to the directions indicated by the arrows indicating the X axis, the Y axis, and the Z axis are negative directions along the X axis, the Y axis, and the Z axis, respectively. The negative directions along the X axis, the Y axis, and the Z axis are indicated by an −X direction, a −Y direction, and a −Z direction, respectively. The directions along the X axis, the Y axis, and the Z axis regardless of positive or negative are referred to as an X direction, a Y direction, and a Z direction, respectively.

The X direction is a direction corresponding to a width direction of the discharge tray 36, and is a direction parallel to the scanning direction of the recording head 41. The +X direction is a direction facing one end of the discharge tray 36, and the −X direction is a direction facing the other end of the discharge tray 36. The Y direction is a direction corresponding to a thickness direction of the discharge tray 36. The +Y direction is a direction facing the front of the discharge tray 36, and the −Y direction is a direction facing the rear of the discharge tray 36. The Z direction is a direction corresponding to a movement direction of the discharge-side first member 200 and the discharge-side second member 250. The +Z direction indicates the transport direction of the medium M in the discharge tray 36, and also corresponds to a pulling direction being a movement direction when the discharge-side first member 200 and the discharge-side second member 250 are pulled out of the main body 31 of the recording device 30. The −Z direction corresponds to a housing direction being a movement direction when the discharge-side first member 200 and the discharge-side second member 250 are housed in the main body 31 of the recording device 30. The XYZ axes illustrated in FIGS. 19 to 23 correspond to the XYZ axes in FIG. 19. Note that, in the following description, the discharge-side first member 200 is simply referred to as a first member 200 and the discharge-side second member 250 is simply referred to as a second member 250.

As illustrated in FIG. 19, the discharge tray 36 has the medium supporting structure of the two-stage structure constituted of the first member 200 and the second member 250. The discharge tray 36 has a housing state in which the second member 250 is housed in the first member 200, and a developed state in which the second member 250 is pulled out of the first member 200 by a user operation and the medium M can be supported by the first member 200 and the second member 250. The discharge tray 36 is configured to be operable from the housing state to the developed state when the discharge port 35 is in the open state.

The first member 200 is coupled to the main body 31 of the recording device 30 so as to be movable in the Z direction. The first member 200 is a housing member that can house the second member 250. The first member 200 includes a discharge-side first frame body 201 and a discharge-side first support-surface forming portion 202. The second member 250 is coupled to the first member 200 so as to be movable in the Z direction. The second member 250 is supported by the main body 31 of the recording device 30 via the first member 200. The second member 250 includes a discharge-side second frame body 251 and a plurality of discharge-side ribs 252 extending in the Z direction. Note that, in the following description, the discharge-side first frame body 201 is simply referred to as a first frame body 201, the discharge-side first support-surface forming portion 202 is simply referred to as a first support-surface forming portion 202, the discharge-side second frame body 251 is simply referred to as a second frame body 251, and the discharge-side rib 252 is simply referred to as a rib 252.

As illustrated in FIG. 19, the first frame body 201 forms a frame shape being open in the +Z direction. The first frame body 201 includes a pair of first outer frames 203 and 204 extending in the Z direction and a first rear frame 205 that couples end portions in the −Z direction of the first outer frames 203 and 204.

Figure 20:
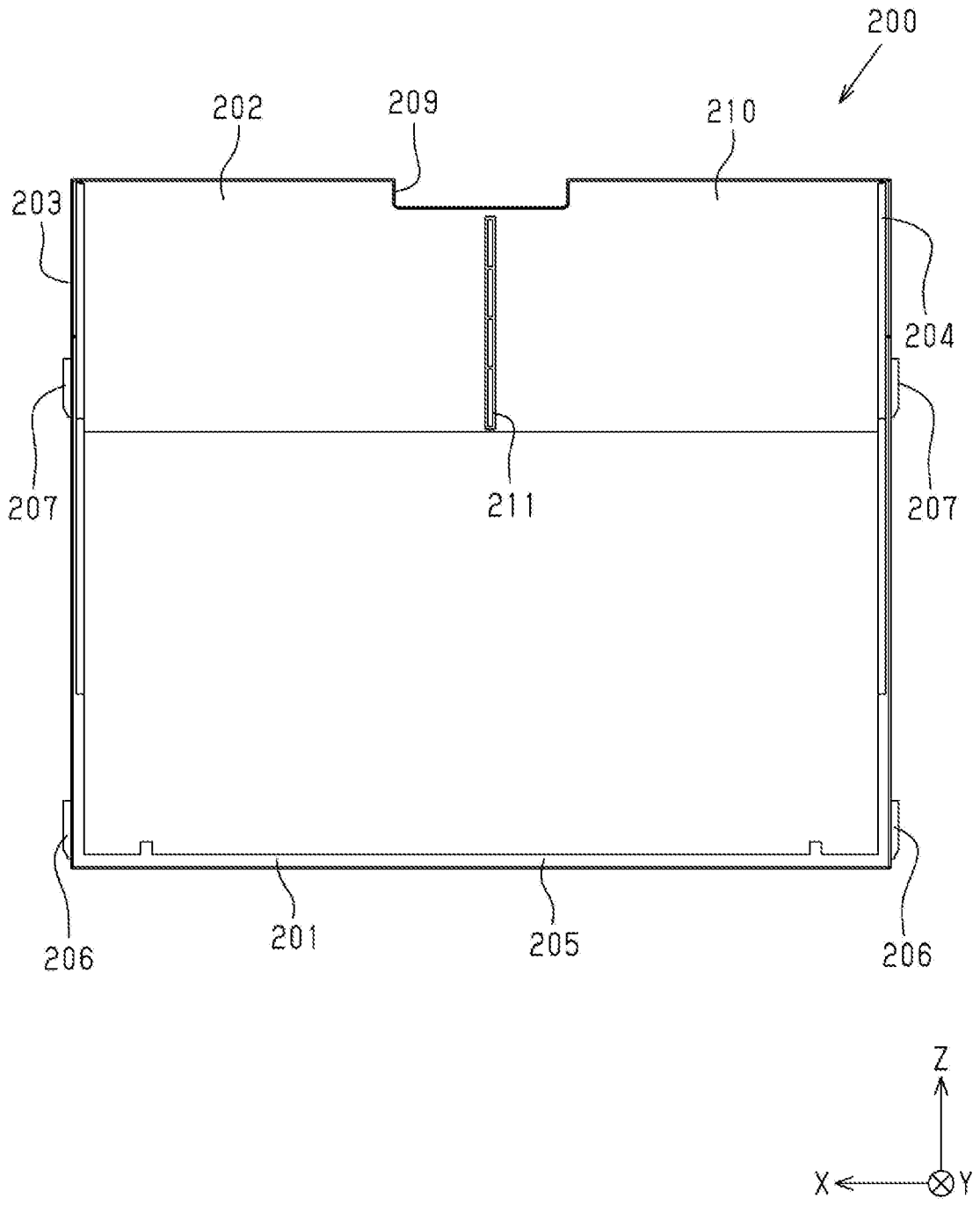
FIG. 20 is a rear view illustrating a discharge-side first member in the modified example.

As illustrated in FIGS. 19 and 20, the first frame body 201 includes, in each of the first outer frames 203 and 204, a first main body engagement protruding portion 206 and a second main body engagement protruding portion 207 that protrude outward in the Y direction. The first main body engagement protruding portion 206 is located at the end portions in the −Z direction of the first outer frames 203 and 204. The second body engagement protruding portion 207 is located in the −Y direction relative to a portion to which an end portion in the −Z direction of the first support-surface forming portion 202 is coupled. The first main body engagement protruding portion 206 and the second main body engagement protruding portion 207 engage with a guide groove (not illustrated) extending in the Z direction formed in the main body 31 of the recording device 30. The first main body engagement protruding portion 206 and the second main body engagement protruding portion 207 are guided by the guide groove, and thus the first member 200 is coupled to the main body 31 of the recording device 30 so as to be movable in the Z direction. The first member 200 is configured to be movable between a housing position and a use position that are relative positions with respect to the main body 31 of the recording device 30. The housing position is a position in which the first member 200 is housed in the main body 31 of the recording device 30. The use position is a position in which the first member 200 protrudes in the +Z direction from the discharge port 35 of the main body 31 of the recording device 30.

The first support-surface forming portion 202 has a flat plate shape including the X direction and the Z direction. The first support-surface forming portion 202 spans the first outer frames 203 and 204 in a portion on the +Z direction side of the first frame body 201, and is integrally coupled to the end portion in the +Y direction of each of the first outer frames 203 and 204. The first member 200 includes, in the +Y direction, a planar discharge-side first support surface 208 that is a surface including the X direction and the Z direction and can support the medium M. The first member 200 is configured to be able to house the second member 250 in a space surrounded by the first frame body 201 and the first support-surface forming portion 202. Further, the first support-surface forming portion 202 includes, in a central portion in the X direction of an end portion in the +Z direction, a discharge tray operating port 209 that exposes, in the +Y direction, a discharge tray operating portion 261 formed in the second member 250 in the housing state.

Figure 21:
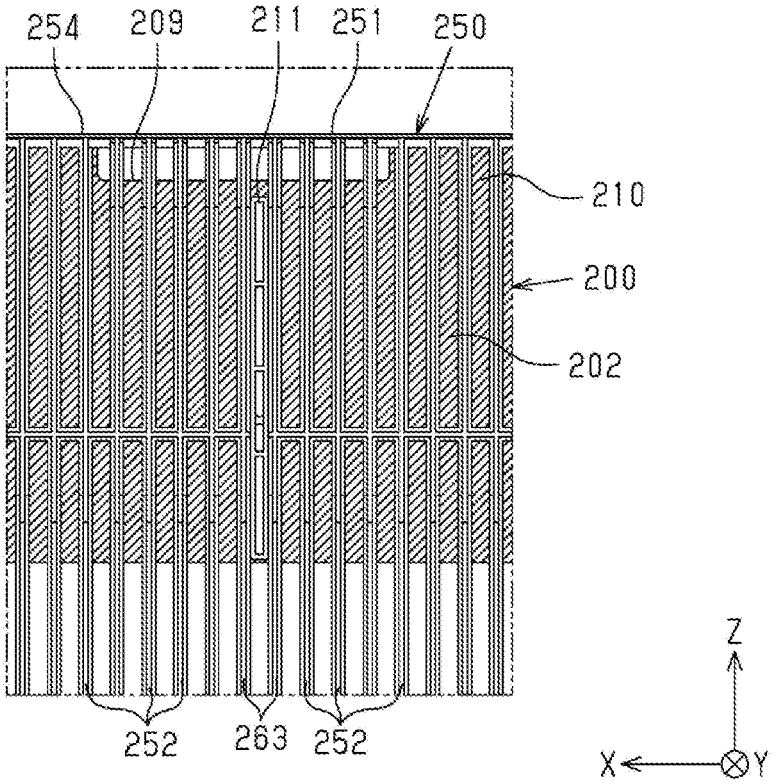
FIG. 21 is a plan view illustrating an engagement portion between a rib guide portion of the discharge-side first member and a rib of a discharge-side second member in the modified example.

As illustrated in FIGS. 20 and 21, the first support-surface forming portion 202 includes a rib guide portion 211 on a rear surface 210 located on a side opposite to the discharge-side first support surface 208. The rib guide portion 211 is constituted of a projecting portion projecting in the −Y direction from the rear surface 210. The rib guide portion 211 extends in the center in the X direction of the rear surface 210 from the end portion in the −Z direction to the vicinity of the end portion in the +Z direction. When the second member 250 is assembled to the first member 200, the rib guide portion 211 is disposed in a position sandwiched in the X direction by the pair of ribs 252 adjacent to each other in the X direction. In this way, the rib guide portion 211 restricts displacement in the X direction of the first member 200 while guiding a movement in the Z direction of the first member 200. Note that, in FIG. 21, a hatching pattern is provided to the rear surface 210 of the first support-surface forming portion 202.

Figure 22:
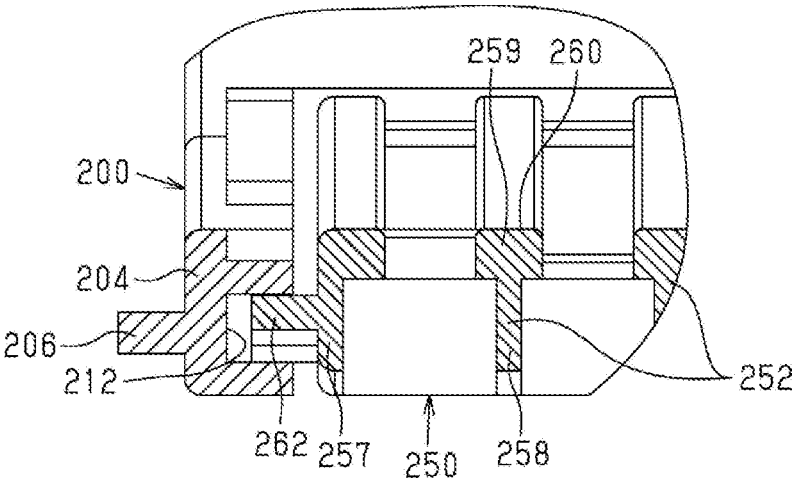
FIG. 22 is a cross-sectional view illustrating an engagement portion between a first outer frame of the discharge-side first member and a discharge-side second frame body of the discharge-side second member in a portion surrounded by a chain double-dashed line 22 in FIG. 19 in the modified example.

As illustrated in FIG. 22, the first frame 201 includes a frame body guide portion 212 on each of the first outer frames 203 and 204. The frame body guide portion 212 is a passage in which a protruding portion 262 formed on both end portions of the second frame body 251 in the X direction is disposed so as to be movable in the Z direction. The frame body guide portion 212 is formed in a groove shape having the inside in the X direction open and extending in the Z direction. The frame body guide portion 212 is open in the end surface in the +Z direction in the first outer frames 203 and 204. The frame body guide portion 212 sandwiches the protruding portion 262 of the second frame body 251 in the Y direction, thereby restricting displacement in the Y direction of the second member 250 while guiding a movement in the Z direction of the second member 250.

Figure 23:
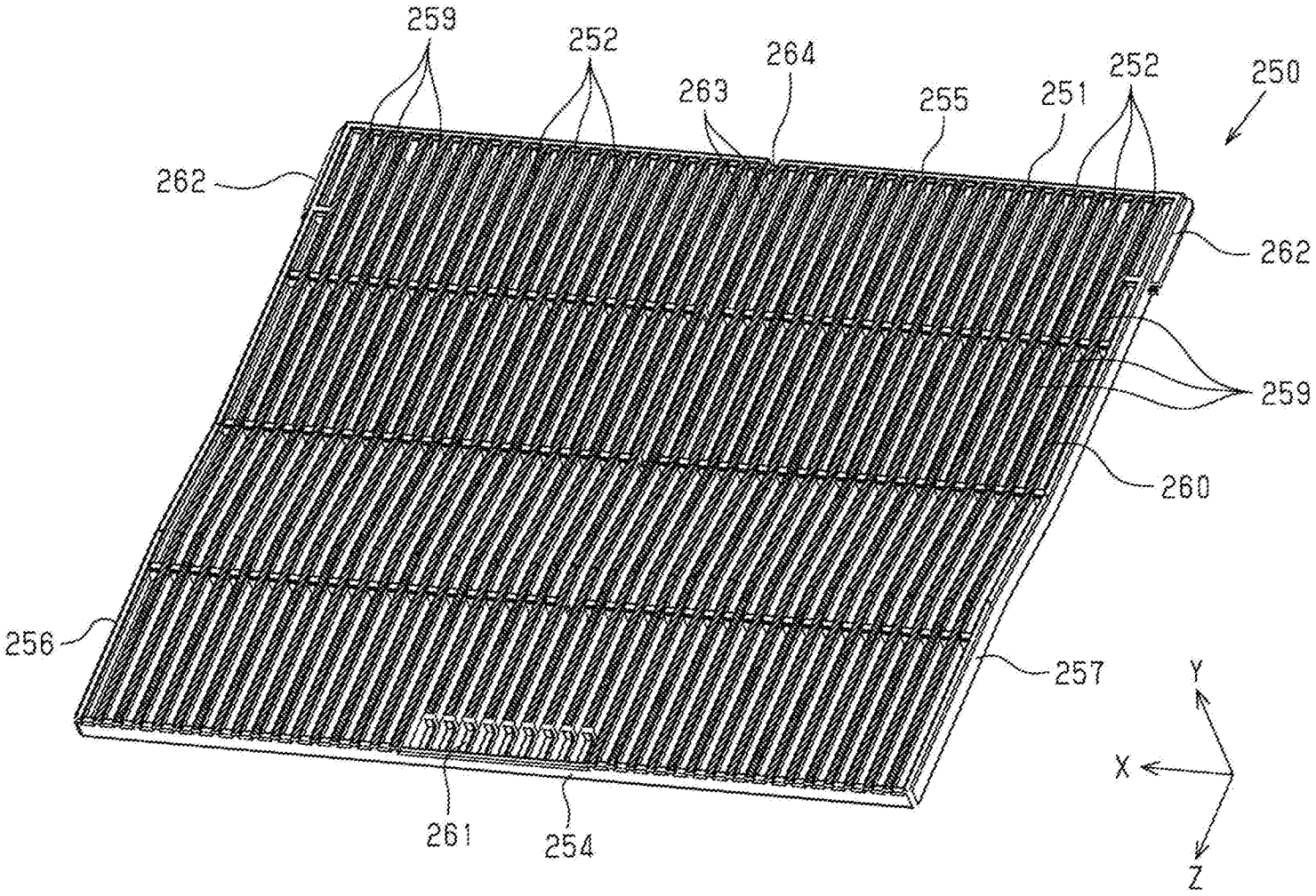
FIG. 23 is a perspective view illustrating the discharge-side second member in the modified example.

As illustrated in FIG. 23, the second frame body 251 forms an outer peripheral portion of the second member 250. The second frame body 251 includes a second front frame 254, a second rear frame 255, a second outer frame 256, and a second outer frame 257. The second front frame 254 is located in the +Z direction in the second frame body 251, and extends in the X direction. The second rear frame 255 is located in the −Z direction in the second frame body 251, and extends in the X direction. The second outer frame 256 is located in the +X direction in the second frame body 251, and is integrally coupled to an end portion of the second front frame 254 and an end portion of the second rear frame 255 in the +X direction. The second outer frame 257 is located in the −X direction in the second frame body 251, and is integrally coupled to an end portion of the second front frame 254 and an end portion of the second rear frame 255 in the −X direction. The second outer frames 256 and 257 include a portion inclined toward the Z direction at a portion on the second front frame 254 side in the Z direction such that the second front frame 254 is located slightly closer to the +Z direction side than the second rear frame 255.

The rib 252 is integrally coupled to the second frame body 251. The rib 252 is integrally coupled to the second front frame 254 and the second rear frame 255. The rib 252 includes a portion that is inclined toward the Z direction at a portion on the second front frame 254 side in the Z direction so as to conform to the pair of second outer frames 256 and 257, and spans the second frame 251 in the Z direction. The ribs 252 are arranged in the X direction at predetermined intervals.

As illustrated in FIGS. 22 and 23, the rib 252 includes a rib main body 258 and a second support-surface forming portion 259. The rib main body 258 is formed in a flat plate shape extending in the Z direction with a longitudinal direction set to the Y direction in a transverse cross section of the rib 252 being a cross section orthogonal to the direction in which the rib 252 extends. The second support-surface forming portion 259 is integrally coupled to an end portion in the +Y direction of the rib main body 258. The second support-surface forming portion 259 is formed so as to have a width in the X direction greater than that of the rib main body 258 in the transverse cross section of the rib 252. In other words, the second support-surface forming portion 259 is formed in a shape that protrudes from the end portion in the +Y direction of the rib main body 258 toward at least one of the +X direction and the −X direction. The rib 252 is formed in a shape that widens at the end portion in the +Y direction in the transverse cross section thereof. The second support-surface forming portion 259 forms a discharge-side second support surface 260 by a portion located in the +Y direction. Note that, in FIG. 23, a hatching pattern is provided to the portion of each of the ribs 252 constituting the discharge-side second support surface 260. Further, the second member 250 includes the discharge tray operating portion 261 at an end portion in the +Z direction of the central portion in the X direction. The discharge tray operating portion 261 is constituted of a recessed portion being recessed in the −Y direction and formed in a part of the second rib 152 located in the central portion in the X direction.

As illustrated in FIGS. 22 and 23, the second frame body 251 includes the pair of protruding portions 262. One of the pair of protruding portions 262 is located at an end portion in the +X direction of the second frame body 251, and protrudes in the +X direction toward the outside of the second frame body 251. One of the pair of protruding portions 262 engages with the frame body guide portion 212 formed on the first outer frame 203 of the first member 200. The other of the pair of protruding portions 262 is located at an end portion in the −X direction of the second frame body 251, and protrudes in the −X direction toward the outside of the second frame body 251. The other of the pair of protruding portions 262 engages with the frame body guide portion 212 formed on the first outer frame 204 of the first member 200. The protruding portion 262 engages with the frame body guide portion 212 of the protruding portion 262, thereby guiding a movement in the Z direction of the second member 250 with respect to the first member 200, and also restricting displacement in the Y direction of the second member 250.

As illustrated in FIG. 23, of the plurality of ribs 252, the pair of ribs 252 adjacent to each other at the center in the X direction are engagement ribs 263 that engage with the rib guide portion 211 of the first member 200. The engagement ribs 263 engage with the rib guide portion 211, thereby guiding a movement in the Z direction of the second member 250 with respect to the first member 200, and also restricting displacement in the X direction of the second member 250. Note that an insertion port 264 into which the rib guide portion 211 of the first member 200 can be inserted in the +Z direction from the −Z direction is formed at the end portion in the +Z direction of the central portion in the X direction of the second frame body 251.

The second member 250 is configured to be movable between a housing position and a developed position that are relative positions with respect to the first member 200. The housing position is a position in which the second member 250 is housed in the first member 200, and the discharge-side second support surface 260 is disposed in the −Y direction relative to the discharge-side first support surface 208 of the first member 200. The developed position is a position in which the discharge-side second support surface 260 is disposed in the +Z direction relative to the first member 200.

The discharge tray 36 having such a configuration is assembled by inserting the second member 250 into the first member 200 from the +Z direction to the −Z direction after a position adjustment of the second member 250 to the first member 200 is performed.

The recording device 30 may include a cassette that can house the medium M in a layered state before being fed, and may be configured not to include a feeding tray. In the recording device 30 of the such cassette feeding method, the medium supporting structure may be applied to the discharge tray 36.

The recording device 30 may be a composite machine. The composite machine may include a scanner unit, an automatic document feeding device that feeds a document to the scanner unit, and a document feeding tray that can set a document to be fed to the automatic document feeding device, and the medium supporting structure may be applied to this document feeding tray.

The recording device 30 may be a recording device that sprays and discharges other liquids other than ink. A state of the liquid discharged as a small amount of a liquid droplet from the recording device may also include granular, a tear drop shape, and stringy that leaves a trail. The liquid described herein may be any material that can be sprayed from the recording device. For example, the liquid may be in a state when a substance is a liquid phase, and includes a fluid body such as a liquid body with high or low viscosity, a sol, gel water, other inorganic solvent, an organic solvent, a solution, a liquid resin, a liquid metal, and a metal melt. The liquid includes not only a liquid as one state of a substance, but also particles of a functional material made from a solid substance such as pigments and metal particles, which are dissolved, dispersed, or mixed in a solvent. Representative examples of the liquid include ink, a liquid crystal, and the like described in the exemplary embodiment described above. Herein, the ink includes general water-based ink and oil-based ink, and various liquid composites such as gel ink and hot-melt ink. For example, specific examples of the recording device include a device that sprays liquid including a material such as an electrode material and a color material used in manufacture of liquid crystal displays, electroluminescent displays, surface emitting displays, color filters, and the like in a dispersed or dissolved form. The recording device may also be a device that sprays bioorganic substances used for biochip manufacturing, a device that is used as a precision pipette and sprays liquid to be a sample, a printing apparatus, a micro dispenser, or the like may be used. The recording device may also be a device that sprays lubricant to a precision machine such as a clock or a camera in a pinpoint manner, or a device that sprays a transparent resin liquid such as ultraviolet cure resin or the like on a substrate for forming a tiny hemispherical lens, an optical lens, or the like used for an optical communication element and the like. The recording device may also be a device that sprays an etching solution such as an acid or an alkali for etching a substrate and the like.

The contents derived from the exemplary embodiment described above and the modified examples will be described.

A medium supporting structure includes a first member supported by a main body of a recording device configured to perform recording onto a medium, and a second member that includes a support surface configured to support the medium and is coupled to the first member to be movable relatively to the first member, in a transport direction of the medium on the support surface as a movement direction of the second member, wherein the second member is configured to be housed in the first member, and includes a frame body forming an outer peripheral portion of the second member, and a plurality of ribs spanning across the frame body and form the support surface.

According to the configuration described above, the second member is formed as a structure constituted of the frame body and the plurality of ribs, and thus an inner portion of the frame body is reinforced by the plurality of ribs, and both end portions of the plurality of ribs are reinforced by the frame body. By the interaction between the frame body and the plurality of ribs, a reduction in thickness of the second member can be achieved while securing the mechanical strength of the second member. As a result, a reduction in thickness of the whole medium supporting structure can be achieved while securing the mechanical strength thereof.

In the medium supporting structure described above, each of the plurality of ribs may include a rib main body, and a support-surface forming portion that is integrally coupled to the rib main body to form the support surface, and, when a surface orthogonal to a direction, in which the rib extends, is a transverse cross section, and the transverse cross section is seen in plan view, a length of the support-surface forming portion in an orthogonal direction that is orthogonal, along the support surface, to the direction in which the rib extends may be greater than a length of the rib main body in the orthogonal direction.

According to the configuration described above, the mechanical strength of each of the plurality of ribs and thus the mechanical strength of the second member can be effectively increased.

In the medium supporting structure described above, the plurality of ribs may extend in the transport direction of the medium at the support surface.

According to the configuration described above, since the ribs extend in the transport direction of the medium on the support surface, the medium and the ribs are less likely to interfere with each other.

In the medium supporting structure described above, the first member may include a rib guide portion configured to engage with the rib, guide a movement of the second member in the movement direction, and also restrict displacement of the second member in a width direction thereof, the direction being a direction orthogonal to the movement direction, in plan view, at the support surface.

According to the configuration described above, the first member restricts the displacement of the second member in the width direction while guiding the movement of the second member in the movement direction by using the rib extending along the movement direction of the second member. In this way, since it is not necessary to separately provide the second member with a portion configured to guide a movement in the movement direction and a portion configured to restrict displacement in the width direction, the configuration of the second member can be simplified.

The medium supporting structure described above may include a low friction member that has a friction coefficient lower than those of the rib guide portion and the rib and is interposed between the rib guide portion and the rib.

According to the configuration described above, since the frictional force acting between the first member and the second member during a movement of the second member is reduced, the movement of the second member can be performed smoothly.

In the medium supporting structure described above, the first member may include one end-side rib guide portion configured to engage with a rib located at one end side of the second member in the width direction, and another end-side rib guide portion configured to engage with a rib located on another end side of the second member in the width direction.

According to the configuration described above, guiding of the second member in the movement direction and a restriction on the displacement of the second member in the width direction can be performed at a plurality of places. In this way, rattling of the second member so as to rotate with, as a rotation axis, an axis along a thickness direction orthogonal to the support surface can be effectively suppressed.

In the medium supporting structure described above, the one end-side rib guide portion may engage with a rib located in a position closer to a center of the second member in the width direction than to the one end of the second member in the width direction, and the other end-side rib guide portion may engage with a rib located in a position closer to the center of the second member in the width direction than to the other end of the second member in the width direction.

According to the configuration described above, the one end-side rib guide portion guides the rib located in a position closer to the center of the second member than the one end of the second member in the width direction. The other end-side rib guide portion guides the rib located in a position closer to the center of the second member than the other end of the second member in the width direction. According to such a configuration, rattling of the second member so as to rotate with, as a rotation axis, an axis along a thickness direction orthogonal to the support surface can be further suppressed effectively.

In the medium supporting structure described above, a protruding portion that protrudes outward in the width direction may be provided to the frame body of the second member, and the first member may include a frame body guide portion configured to engage with the protruding portion, guide a movement of the second member in the movement direction, and moreover restrict displacement of the second member in a thickness direction thereof, the direction being orthogonal to the support surface.

According to the configuration described above, the first member restricts the displacement of the second member in the thickness direction while guiding the movement of the second member in the movement direction by using the protruding portion that protrudes outward in the width direction. In this way, an effect of the configuration that restricts the displacement of the second member in the thickness direction on a reduction in thickness of the first member and the second member can be reduced.

In the medium supporting structure described above, the support surface may be a second support surface, and the first member may include a first support surface that is a support surface configured to support the medium.

According to the configuration described above, since the first member can support the medium, a load associated with the support of the medium is dispersed in the first member and the second member. In this way, a load acting on the engagement portion of the first member and the second member can be effectively dispersed.

In the medium supporting structure described above, the frame body may be a second frame body, the rib may be a second rib, the first member may include a first frame body forming an outer peripheral portion of the first member, and a plurality of first ribs spanning across the first frame body along a movement direction of the second member to form the first support surface, and the second rib may be located between the first ribs.

According to the configuration described above, since the first member is constituted of the first frame body and the plurality of first ribs, and the rib guide portion is constituted of the first rib, a reduction in thickness of the first member can be achieved while securing the mechanical strength of the first member. Further, since the second rib is located between the first ribs, an occupied region of the first member can be effectively used. As a result, a further reduction in thickness of the medium supporting structure can be achieved.

In the medium supporting structure described above, the rib guide portion may be constituted of the first rib.

Since the second member is guided by using the first rib as in the configuration described above, it is not necessary to separately provide a portion configured to guide a movement of the second member in the movement direction and a portion configured to restrict displacement of the second member in the width direction. Thus, the configuration of the first member can be simplified.

In the medium supporting structure described above, the rib main body may be a second rib main body, the support-surface forming portion may be a second support-surface forming portion, each of the plurality of first ribs may include a first rib main body, and a first support-surface forming portion that is integrally coupled to the first rib main body to form the first support surface, and, when a surface orthogonal to a direction, in which the first rib extends, is a transverse cross section and the transverse cross section is seen in plan view, a length of the first support-surface forming portion in an orthogonal direction that is orthogonal, along the first support surface, to the direction in which the first rib extends may be greater than a length of the first rib main body in the orthogonal direction.

According to the configuration described above, the mechanical strength of each of the plurality of first ribs and thus the mechanical strength of the first member can be effectively increased while achieving a reduction in thickness of the first member.

In the medium supporting structure described above, the first rib and the second rib may have colors different from each other.

According to the configuration described above, a failure of the second member to be pulled out of the first member is easily visually confirmed.

The medium supporting structure described above further includes a third member coupled to the main body of the recording device, wherein the third member may be configured to house the first member and the second member, and the first member may be coupled to the third member to be movable, in a transport direction of the medium on the first support surface as a movement direction, along the movement direction to and from a position in which the third member can be supported relatively.

According to the configuration described above, since the first member and the second member are configured to be housed by the third member, a foreign matter entering various engagement portions can be suppressed by housing the first member and the second member in the third member.

In the medium supporting structure described above, the third member may be configured to support, together with the first support surface and the second support surface, the medium.

According to the configuration described above, since the third member is configured to support the medium, a reduction in size of the medium supporting structure in the housing state in which the third member houses the first member and the second member can be achieved while achieving an increase in region in which the medium can be supported.

Further, according to the configuration described above, a load associated with the support of the medium is dispersed in the third member, the first member, and the second member. In this way, a load acting on each of the engagement portions can be effectively dispersed.

A recording device includes a feeding tray, a discharge tray, and a main body of a recording device, to which the feeding tray and the discharge tray are coupled, the recording device being configured to perform recording onto a medium in a process of transporting the medium from the feeding tray to the discharge tray, where at least one of the feeding tray and the discharge tray includes the medium supporting structure described above. According to such a configuration, an effect similar to that in the medium supporting structure described above can be obtained.

What is claimed is:

1. A medium supporting structure, comprising:

a first member supported by a main body of a recording device configured to perform recording onto a medium; and a second member that includes a support surface configured to support the medium and is coupled to the first member to be movable relatively to the first member, in a transport direction of the medium on the support surface as a movement direction of the second member, wherein the second member is configured to be housed in the first member, and includes a frame body forming an outer peripheral portion of the second member, a plurality of ribs spanning across the frame body to form the support surface, a plurality of openings, each of which is formed by two ribs adjacent to each other among the plurality of ribs and the frame body, is formed periodically in a direction that intersects, along the support surface, to a direction in which the rib extends.

2. The medium supporting structure according to claim 1, wherein each of the plurality of ribs includes a rib main body, and a support-surface forming portion that is integrally coupled to the rib main body to form the support surface, and when a surface orthogonal to a direction, in which the rib extends, is a transverse cross section and the transverse cross section is seen in plan view, a length of the support-surface forming portion in an orthogonal direction that is orthogonal, along the support surface, to the direction in which the rib extends is greater than a length of the rib main body in the orthogonal direction.

3. The medium supporting structure according to claim 2, wherein the plurality of ribs extend in the transport direction of the medium at the support surface.

4. The medium supporting structure according to claim 3, wherein the first member includes a rib guide portion configured to engage with the rib, guide a movement of the second member in the movement direction, and also restrict displacement of the second member in a width direction thereof, the direction being a direction orthogonal to the movement direction, in plan view, at the support surface.

5. The medium supporting structure according to claim 4, comprising a low friction member that has a friction coefficient lower than those of the rib guide portion and the rib and is interposed between the rib guide portion and the rib.

6. The medium supporting structure according to claim 5, wherein the first member includes one end-side rib guide portion configured to engage with a rib located at one end side of the second member in the width direction, and another end-side rib guide portion configured to engage with a rib located at another end side of the second member in the width direction.

7. The medium supporting structure according to claim 6, wherein the one end-side rib guide portion engages with a rib located in a position closer to a center of the second member in the width direction than to the one end of the second member in the width direction, and the other end-side rib guide portion engages with a rib located in a position closer to the center of the second member in the width direction than to the other end of the second member in the width direction.

8. The medium supporting structure according to claim 4, wherein a protruding portion that protrudes outward in the width direction is provided to the frame body of the second member, and the first member includes a frame body guide portion configured to engage with the protruding portion, guide a movement of the second member in the movement direction, and moreover restrict displacement of the second member in a thickness direction thereof, the direction being orthogonal to the support surface.

9. The medium supporting structure according to claim 4, wherein the support surface is a second support surface, and the first member includes a first support surface that is a support surface configured to support the medium.

10. The medium supporting structure according to claim 9, wherein the frame body is a second frame body, the rib is a second rib, the first member includes a first frame body forming an outer peripheral portion of the first member, and a plurality of first ribs spanning across the first frame body along a movement direction of the second member to form the first support surface, and the second rib is located between the first ribs.

11. The medium supporting structure according to claim 10, wherein the rib guide portion is constituted of the first rib.

12. The medium supporting structure according to claim 10, wherein the rib main body is a second rib main body, the support-surface forming portion is a second support-surface forming portion, each of the plurality of first ribs includes a first rib main body, and a first support-surface forming portion that is integrally coupled to the first rib main body to form the first support surface, and when a surface orthogonal to a direction, in which the first rib extends, is a transverse cross section and the transverse cross section is seen in plan view, a length of the first support-surface forming portion in an orthogonal direction that is orthogonal, along the first support surface, to the direction in which the first rib extends is greater than a length of the first rib main body in the orthogonal direction.

13. The medium supporting structure according to claim 10, wherein the first rib and the second rib have colors different from each other.

14. The medium supporting structure according to claim 10, comprising a third member coupled to the main body of the recording device, wherein the third member is configured to house the first member and the second member, and the first member is coupled to the third member to be movable relatively to the third member, in a transport direction of the medium on the first support surface as a movement direction of the first member.

15. The medium supporting structure according to claim 14, wherein the third member is configured to support, together with the first support surface and the second support surface, the medium.

16. A recording device, comprising:

a feeding tray;

a discharge tray; and a main body of a recording device, to which the feeding tray and the discharge tray are coupled, the recording device being configured to perform recording onto a medium in a process of transporting the medium from the feeding tray to the discharge tray, wherein at least one of the feeding tray and the discharge tray includes the medium supporting structure according to claim 1.

* * * * *